US006992652B2

(12) United States Patent
Koyama

(10) Patent No.: US 6,992,652 B2
(45) Date of Patent: Jan. 31, 2006

(54) LIQUID CRYSTAL DISPLAY DEVICE AND DRIVING METHOD THEREOF

(75) Inventor: Jun Koyama, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 212 days.

(21) Appl. No.: 09/916,306

(22) Filed: Jul. 30, 2001

(65) Prior Publication Data

US 2002/0024485 A1 Feb. 28, 2002

(30) Foreign Application Priority Data

Aug. 8, 2000 (JP) ..... 2000-240332

(51) Int. Cl.
*G09G 3/36* (2006.01)

(52) U.S. Cl. ..... 345/98; 345/87

(58) Field of Classification Search ..... 345/87–102, 345/76–83, 204, 211; G06G 3/30, 3/32, G06G 3/36
See application file for complete search history.

(56) References Cited

U.S. PATENT DOCUMENTS

| | | | | |
|---|---|---|---|---|
| 4,432,610 A | * | 2/1984 | Kobayashi et al. | 349/42 |
| 4,752,118 A | * | 6/1988 | Johnson | 349/54 |
| 4,773,738 A | | 9/1988 | Hayakawa et al. | 349/34 |
| 4,996,523 A | | 2/1991 | Bell et al. | |
| 5,091,722 A | | 2/1992 | Kitajima et al. | 345/89 |
| 5,125,045 A | | 6/1992 | Murakami et al. | |
| 5,200,846 A | | 4/1993 | Hiroki et al. | 349/174 |
| 5,225,823 A | | 7/1993 | Kanaly | 345/89 |
| 5,247,190 A | | 9/1993 | Friend et al. | 257/40 |
| 5,339,090 A | | 8/1994 | Crossland et al. | |
| 5,349,366 A | | 9/1994 | Yamazaki et al. | 345/92 |
| 5,424,752 A | | 6/1995 | Yamazaki et al. | 345/92 |
| 5,471,225 A | | 11/1995 | Parks | 345/98 |
| 5,479,283 A | | 12/1995 | Kaneko et al. | 349/138 |
| 5,600,169 A | | 2/1997 | Burgener et al. | 257/352 |
| 5,608,549 A | | 3/1997 | Usami | |
| 5,642,129 A | | 6/1997 | Zavracky et al. | 345/100 |
| 5,673,422 A | | 9/1997 | Kawai et al. | |

(Continued)

FOREIGN PATENT DOCUMENTS

EP 0 999 595 5/2000

(Continued)

OTHER PUBLICATIONS

T. Shimoda et al., "High Resolution Light Emitting Polymer Display Driven by Low Temperature Polysilicon Thin Film Transistor with Integrated Driver", Asia Display '98, 1998, pp. 217-220.

(Continued)

*Primary Examiner*—Alexander Eisen
(74) *Attorney, Agent, or Firm*—Fish & Richardson P.C.

(57) ABSTRACT

It is one of objects to provide a liquid crystal display device capable of low power consumption, with a driver circuit having a new circuit structure and a pixel. In the liquid crystal display device displaying an image using an n bit digital image signal (n is an integer), by incorporating n×m storage circuits (m is an integer) per pixel, it comprises a function of storing an m frame digital image signal in the pixel (in the illustrated figure of an example where n=3, m=2, 3 bits×2 frames are stored in storage circuits A1 to A3, and B1 to B3). Therefore, in the display of a still image, by repeatedly reading the digital image signal stored temporarily in the storage circuit and displaying in each frame, the drive during such time of a source signal line driver circuit is stopped, to reduce the power consumption of the liquid crystal display device.

61 Claims, 20 Drawing Sheets

U.S. PATENT DOCUMENTS

| | | | | |
|---|---|---|---|---|
| 5,699,078 | A | 12/1997 | Yamazaki et al. | 345/89 |
| 5,712,652 | A | 1/1998 | Sato et al. | 345/90 |
| 5,771,031 | A | 6/1998 | Kinoshita et al. | |
| 5,793,344 | A | 8/1998 | Koyama | 345/87 |
| 5,798,746 | A | 8/1998 | Koyama | 345/98 |
| 5,854,628 | A | 12/1998 | Nakagawa | |
| 5,907,313 | A | 5/1999 | Kubota et al. | |
| 5,945,866 | A * | 8/1999 | Fonash et al. | 327/427 |
| 5,945,972 | A * | 8/1999 | Okumura et al. | 345/98 |
| 5,959,598 | A | 9/1999 | McKnight | |
| 5,990,629 | A | 11/1999 | Yamada et al. | 315/169.3 |
| 6,115,019 | A | 9/2000 | Perner | 345/98 |
| 6,165,824 | A | 12/2000 | Takano et al. | 438/160 |
| 6,246,386 | B1 | 6/2001 | Perner | 345/90 |
| 6,259,846 | B1 | 7/2001 | Roach et al. | 385/123 |
| 6,274,887 | B1 | 8/2001 | Yamazaki et al. | 257/72 |
| 6,333,737 | B1 | 12/2001 | Nakajima | |
| 6,344,672 | B2 | 2/2002 | Huffman | |
| 6,344,843 | B1 | 2/2002 | Koyama et al. | |
| 6,356,028 | B1 | 3/2002 | Legagneux et al. | |
| 6,366,026 | B1 | 4/2002 | Saito et al. | |
| 6,384,818 | B1 | 5/2002 | Yamazaki et al. | |
| 6,392,618 | B1 | 5/2002 | Kimura | 345/85 |
| 6,441,829 | B1 * | 8/2002 | Blalock et al. | 345/690 |
| 6,456,267 | B1 | 9/2002 | Sato et al. | |
| 6,535,192 | B1 | 3/2003 | Sung et al. | |
| 6,545,654 | B2 | 4/2003 | Jacobsen et al. | |
| 6,545,708 | B1 | 4/2003 | Tamayama et al. | |
| 6,549,196 | B1 | 4/2003 | Taguchi et al. | |
| 6,556,176 | B1 | 4/2003 | Okuyama et al. | |
| 6,563,480 | B1 | 5/2003 | Nakamura | |
| 6,564,237 | B2 | 5/2003 | Ohashi et al. | |
| 6,630,916 | B1 | 10/2003 | Shinoda | 345/60 |
| 6,636,194 | B2 | 10/2003 | Ishii | |
| 6,670,938 | B1 | 12/2003 | Yoshida | |
| 6,683,596 | B2 | 1/2004 | Ozawa | |
| 6,731,264 | B2 | 5/2004 | Koyama et al. | |
| 6,738,054 | B1 | 5/2004 | Yamaguchi | |
| 6,747,623 | B2 | 6/2004 | Koyama | |
| 6,750,836 | B1 | 6/2004 | Katayama et al. | |
| 6,765,562 | B2 | 7/2004 | Yamazaki et al. | |
| 6,774,876 | B2 | 8/2004 | Inukai | |
| 2001/0005193 | A1 | 6/2001 | Yokoyama | |
| 2002/0000969 | A1 | 1/2002 | Ozawa | |
| 2002/0003521 | A1 | 1/2002 | Matsueda et al. | |
| 2002/0018029 | A1 | 2/2002 | Koyama | 345/39 |
| 2002/0021274 | A1 | 2/2002 | Koyama et al. | |
| 2002/0021295 | A1 | 2/2002 | Koyama et al. | |
| 2002/0024054 | A1 | 2/2002 | Koyama et al. | 345/204 |
| 2002/0024485 | A1 | 2/2002 | Koyama | |
| 2002/0036604 | A1 | 3/2002 | Yamazaki et al. | |
| 2002/0039087 | A1 | 4/2002 | Inukai | |
| 2002/0041266 | A1 | 4/2002 | Koyama et al. | |
| 2002/0057244 | A1 | 5/2002 | Koyama et al. | |
| 2002/0089483 | A1 | 7/2002 | Yamazaki et al. | |
| 2002/0113763 | A1 | 8/2002 | Koyama | |
| 2002/0130828 | A1 | 9/2002 | Yamazaki et al. | |
| 2003/0067632 | A1 | 4/2003 | Ohta et al. | |
| 2003/0071772 | A1 | 4/2003 | Kimura | |
| 2003/0098875 | A1 | 5/2003 | Kurokawa et al. | |
| 2003/0103025 | A1 | 6/2003 | Kurokawa et al. | |
| 2004/0164322 | A1 | 8/2004 | Kondo et al. | |
| 2004/0183766 | A1 | 9/2004 | Koyama et al. | |
| 2004/0222955 | A1 | 11/2004 | Koyama | |

FOREIGN PATENT DOCUMENTS

| | | |
|---|---|---|
| EP | 1 098 290 | 5/2001 |
| EP | 1182638 | 2/2002 |
| JP | 04-350627 | 12/1992 |
| JP | 06-102530 | 4/1994 |
| JP | 08-101609 | 4/1996 |
| JP | 08-101669 | 4/1996 |
| JP | 08-194205 | 7/1996 |
| JP | 08-286170 | 11/1996 |
| JP | 09-212140 | 8/1997 |
| JP | 10-092576 | 4/1998 |
| JP | 10-214060 | 8/1998 |
| JP | 10-232649 | 9/1998 |
| JP | 10-247735 | 9/1998 |
| JP | 10-253941 | 9/1998 |
| JP | 10-312173 | 11/1998 |
| JP | 11-064814 | 3/1999 |

OTHER PUBLICATIONS

C. Han et al., "3.8 Green OLED with low temperature poly Si TFT", Euro Display '99, Sep. 6-9, 1999, pp. 27-30.

H. Schenk et al., "Polymers for Light Emitting Diodes", Euro Display '99, Sep. 6-9, 1999, pp. 33-37.

T. Shimoda et al., "Current Status and Future of Light-Emitting Polymer Display Driven by Poly-Si TFT", SID '99 DIGEST, 1999, pp. 372-375.

U.S. Appl. No. 09/930,956, US5156, dated Nov. 4, 2004.

U.S. Appl. No. 09/930,956, US5156, dated Apr. 19, 2004.

U.S. Appl. No. 09/930,956, US5156, dated Oct. 28, 2003.

U.S. Appl. No. 09/919,832, US5165

U.S. Appl. No. 09/919,832, US5165, dated Sep. 8, 2004.

U.S. Appl. No. 09/923,433, US5158, dated Jul. 28, 2004.

M.A. Baldo et al.; "Highly Efficient Phosphorescent Emission from Organic Electroluminescent Devices"; *Nature*, Vol. 395; pp. 151-154; Sep. 10, 1998.

M.A. Baldo et al.; "Very High-Efficiency Green Organic Light-Emitting Devices Based on Electrophosphorescence"; *Applied Physics Letters*, vol. 75(1); pp. 4-6; Jul. 5, 1999.

Tsutsui et al.; "Electroluminescence in Organic Thin Film"; *Photochemical Processes in Organized Molecular Systems*; pp. 437-450; 1991.

Tsutsui et al.; "High Quantum Efficiency in Organic Light-Emitting Devices with Irdium-Comolex as a Triplet Emissive Center"; *Japanese Journal of Applied Physics*; vol. 38, Part 12B; pp. L1502-L1504; Dec. 15, 1999.

1999 International Workshop on Active-Matrix Liquid-Crystal Displays; Digest of Technical Papers; July 14-16, 1999; pp. 29-32.

* cited by examiner

LIQUID CRYSTAL DISPLAY DEVICE AND DRIVING METHOD THEREOF

BACKGROUND OF THE INVENTION

1. Field of the Invention

The present invention relates to a driver circuit of a semiconductor display device (hereinafter referred to as display device), and to a display device provided with the driver circuit. More particularly, the present invention relates to a driver circuit of an active matrix display device having a thin film transistor formed on an insulator and an active matrix display device provided with the driver circuit. Of those, in particular, the present invention relates to a driver circuit of an active matrix liquid crystal display device using a digital image signal as an image source and an active matrix liquid crystal display device provided with the driver circuit.

2. Description of the Related Art

Recently, the spreading of a display device formed with a semiconductor thin film on an insulator, particularly on a glass substrate, and in particular to an active matrix display device provided with the thin film transistor (hereinafter referred to as TFT) is significant. The active matrix display device using a TFT has several hundred thousands to several millions of TFTs arranged in a matrix, and the display of images are performed by controlling an electric field of each pixel.

Further, recently, techniques relating to polysilicon TFTs which simultaneously form a driver circuit using TFTs in the periphery of a pixel portion, in addition to pixel TFTs structuring the pixel is developing. This technique greatly contributes to miniaturization of a device and low power consumption, and in addition to that, the liquid crystal display device is becoming an indispensable device to a display portion or the like of mobile equipment which has significantly increased field of use recently.

A schematic diagram of a normal digital method liquid crystal display device is shown in FIG. 13. A pixel portion 1308 is arranged in the center. On the upper side of the pixel portion is a source signal line driver circuit 1301 for controlling the source signal line. The source signal line driver circuit 1301 is comprised of a first latch circuit 1304, a second latch circuit 1305, a D/A converter circuit 1306, an analog switch 1307 and the like. On the right and left side of the pixel portion is arranged a gate signal line driver circuit 1302 for controlling the gate signal line. Note that, in FIG. 13 the gate signal line driver circuit 1302 is arranged on both the right and left side of the pixel portion, but may be arranged on only one side. However, it is preferable from the point of view of the driver efficiency and driver reliability that they are arranged on both sides of the pixel portion.

The source signal line driver circuit 1301 has a structure as shown in FIG. 14. The driver circuit shown as an example in FIG. 14 is a source signal line driver circuit corresponding to a display of a horizontal resolution of 1024 pixels and a 3 bit digital tone, and comprises a shift register circuit (SR) 1401, a first latch circuit (LAT1) 1402, a second latch circuit (LAT2) 1403, a D/A converter circuit (D/A) 1404 or the like. Note that, although not shown in FIG. 14, a buffer circuit, a level shift circuit or the like may be arranged if necessary.

The operations are described briefly with reference to FIGS. 13 and 14. First, a shift register circuit 1303 (shown as SR in FIG. 14) is input with a clock signal (S-CLK, S-CLKb) and a start pulse (S-SP), and is sequentially output with a sampling pulse. Subsequently, the sampling pulse is input to the first latch circuit 1304 (shown as LAT1 in FIG. 14), and a digital image signal (digital data) also input to the first latch circuit 1304 are respectively maintained. This period is referred to as a dot data sampling period. Here, D1 is the most significant bit (MSB:most significant bit) and D3 is the least significant bit (LSB: least significant bit). In the first latch circuit 1304 when holding of digital image signals for one horizontal period is completed, the digital image signals held in the first latch circuit 1304 are all transferred at once to the second latch circuit 1305 (shown as LAT2 in FIG. 14) according to the input of a latch signal (latch pulse) in a retrace period. The period the digital image signal is transferred from the first latch circuit to the second latch circuit is referred to as a line data latch period.

Thereafter, the shift register circuit 1303 operates again and storing of the digital image signal for the next horizontal period is started. At the same time, the digital image signal stored in the second latch circuit 1305 is converted to an analog image signal by the D/A converter circuit 1306 (shown as DAC in FIG. 14). This digital image signal which is made analog is written in the pixel through the source signal line. By repeating this operation display of the pixel is performed.

In a typical active matrix liquid crystal display device, in order to display a dynamic image smoothly, an updating of the image display is performed approximately 60 times in one second. That is, a digital image signal is supplied to every one frame, and needs to be written in to the pixel every time. Even if the image is a still image, the same signal has to be supplied for every one frame, thus it is necessary for the driver circuit to repeat the processing of the same digital image signal continuously.

There is a method of temporarily writing in the digital image signal of a still image to the external storage circuit, and thereafter supplying the digital image signal from the external storage circuit to the liquid crystal display device for every one frame, but in either case the external storage circuit and the driver circuit need to continue to operate.

Particularly, in mobile equipment, low power consumption is greatly desired. Further, although the mobile equipment is mostly used in a still image mode, as described above, since the driver circuit continues to operate when displaying a still image, low power consumption is obstructed.

SUMMARY OF THE INVENTION

In view of the above problems, one of objects of the present invention is to reduce power consumption of the driver circuit when displaying a still image by using a new circuit.

In order to solve the above problems, the present invention uses the following means.

A plurality of storage circuits (memory circuits) are arranged in the pixel, and digital image signals are stored for every pixel. In the case of the still image, once write in is performed, the information written in to a pixel thereafter are all the same, therefore a still image may be continuously displayed by reading out the stored signals from the storage circuit without inputting a signal for every frame. That is, when displaying a still image, it becomes possible to stop the source signal line driver circuit after performing the processing operation of a signal for at least one frame, and also to largely reduce the power consumption.

Hereinbelow, a structure of the liquid crystal display device of the present invention is described.

According to a first aspect of the present invention, a liquid crystal display device having a plurality of pixels is characterized in that the plurality of pixels respectively have a plurality of storage circuits.

According to a second aspect of the present invention, a liquid crystal display device having a plurality of pixels is characterized in that the plurality of pixels respectively have n×m storage circuits for storing m frames (m is an integer, where 1≦m) of an n bit digital image signal (n is an integer, where 2≦n).

According to a third aspect of the present invention, a liquid crystal display device having a plurality of pixels is characterized in that:

the plurality of pixels each comprises a source signal line, n write-in gate signal lines (n is an integer, where 2≦n), n read gate signal lines, n write-in transistors, n read transistors, n×m storage circuits for storing m frames (m is an integer, where 1≦m) of an n bit digital image signal, n write-in storage circuit selection portions, n read storage circuit selection portions and a liquid crystal element;

gate electrodes of the n write-in transistors are respectively electrically connected to any one of the different n write-in gate signal lines, one of a source and a drain region is electrically connected to a source signal line and the other is electrically connected to any one of the different signal input portions of the n write-in storage circuit selection portions;

the n write-in storage circuit selection portions respectively have m signal output portions, and the m signal output portions respectively are electrically connected to signal input portions of the different m storage circuits;

the n read storage circuit selection portions respectively have m signal input portions, and the m signal input portions respectively are electrically connected to the signal output portions of the different m storage circuits; and the gate electrodes of the n read transistors are respectively electrically connected to any one of the different n read gate signal lines, one of the source region and the drain region is electrically connected to any one of the different signal output portions of the n read storage circuit selection portions, and the other is electrically connected to one electrode of the liquid crystal element.

According to a fourth aspect of the present invention, a liquid crystal display device having a plurality of pixels is characterized in that:

the plurality of pixels each comprises n source signal lines (n is an integer, where 2≦n), a write-in gate signal line, n read gate signal lines, n write-in transistors, n read transistors, n×m storage circuits for storing m frames (m is an integer, where 1≦m) of an n bit digital image signal, n write-in storage circuit selection portions, n read storage circuit selection portions and a liquid crystal element;

gate electrodes of n write-in transistors are respectively electrically connected to the write-in gate signal lines, one of a source region and a drain region is electrically connected to any one of the different n source signal lines and the other is electrically connected to any one of the different signal input portions of the n write-in storage circuit selection portions;

the n write-in storage circuit selection portions respectively have m signal output portions, and the m signal output portions respectively are electrically connected to signal input portions of the different m storage circuits;

the n read storage circuit selection portions respectively have m signal input portions, and the m signal input portions respectively are electrically connected to the signal output portions of the different m storage circuits; and gate electrodes of the n read transistors respectively are electrically connected to any one of the different n read gate signal lines, one of the source region and the drain region is electrically connected to any one of the different signal output portions of the n read storage circuit selection portions, and the other is electrically connected to one electrode of the liquid crystal element.

According to a fifth aspect of the present invention, in any one of the third or fourth aspect of the invention, the liquid crystal display device is characterized in that:

the write-in storage circuit selection portion selects any one of m storage circuits, and becomes in continuity with one of a source region or a drain region of the write-in transistor to thereby write in the digital image signal to the storage circuit; and the read storage circuit selection portion selects any one of the storage circuits storing the digital image signal, and becomes in continuity with one of a source region or a drain region of the read transistor to thereby read the digital image which is stored.

According to a sixth aspect of the present invention, in the third aspect of the invention, the liquid crystal display device is characterized in that:

a shift register which sequentially outputs a sampling pulse according to a clock signal and a start pulse;

a first latch circuit holding n bit digital image signals (n is an integer, where 2≦n) according to the sampling pulse;

a second latch circuit to which the n bit digital image signals held in the first latch circuit are transferred; and a bit signal selection switch which selects in order by each bit the n bit digital image signals transferred to the second latch circuit, and then outputs to the source signal line.

According to a seventh aspect of the present invention, in the fourth aspect of the invention, the liquid crystal display device is characterized by comprising:

a shift register which sequentially outputs a sampling pulse according to a clock signal and a start pulse;

a first latch circuit holding the 1 bit digital image signal from among n bit digital image signals (n is an integer, where 2≦n) according to the sampling pulse; and a second latch circuit to which the 1 bit digital image signal held in the first latch circuit is transferred, and which outputs the 1 bit digital image signal to the source signal line.

According to an eighth aspect of the present invention, in the fourth aspect of the invention, the liquid crystal display device is characterized by comprising:

a shift register which sequentially outputs a sampling pulse according to a clock signal and a start pulse; and a first latch circuit holding a 1 bit digital image signal from among n bit digital image signals (n is an integer, where 2≦n) according to the sampling pulse, and outputs the 1 bit digital image signal to the source signal line.

According to a ninth aspect of the present invention, in any one of the first to eighth aspects of the invention, the liquid crystal display device is characterized in that the storage circuit is a static memory (SRAM).

According to a tenth aspect of the present invention, in any one of the first to eighth aspects of the invention, the liquid crystal display device is characterized in that the storage circuit is a ferroelectric memory (FeRAM).

According to an eleventh aspect of the present invention, in any one of the first to eighth aspects of the invention, the liquid crystal display device is characterized in that the storage circuit is a dynamic memory (DRAM).

According to a twelfth aspect of the present invention, in any one of the first to eighth aspects of the invention, the liquid crystal display device is characterized in that the storage circuit is formed on a glass substrate.

According to a thirteenth aspect of the present invention, in any one of the first to eighth aspects of the invention, the liquid crystal display device is characterized in that the storage circuit is formed on a plastic substrate.

According to a fourteenth aspect of the present invention, in any one of the first to eighth aspects of the invention, the liquid crystal display device is characterized in that the storage circuit is formed on a stainless substrate.

According to a fifteenth aspect of the present invention, in any one of the first to eighth aspects of the invention, the liquid crystal display device is characterized in that the storage circuit is formed on a monocrystalline wafer substrate.

According to a sixteenth aspect of the present invention, a method of driving a liquid crystal display device displaying an image with an n bit digital image signal (n is an integer, where $2 \leqq n$) is characterized in that:

the liquid crystal display device comprises a source signal line driver circuit, a gate signal line driver circuit, and a plurality of pixels;

in the source signal line driver circuit, a sampling pulse is output from a shift register and input to a latch circuit;

in the latch circuit, the digital image signal is held in accordance with the sampling pulse, and the held digital image signal is written in to a source signal line;

in the gate signal line driver circuit, a gate signal line selection pulse is output to select a gate signal line, and in respective plurality of pixels, in a row where the gate signal line is selected, write in of an n bit digital image signal input from the source signal line to the storage circuit, and reading of the n bit digital image signal stored in the storage circuit is performed.

According to a seventeenth aspect of the present invention, a method of driving a liquid crystal display device displaying an image with an n bit digital image signal (n is an integer, where $2 \leqq n$) is characterized in that:

the liquid crystal display device comprises a gate signal line driver circuit and a plurality of pixels;

in the source signal line driver circuit, a sampling pulse is output from a shift register and input to a latch circuit;

in the latch circuit, the digital image signal is held in accordance with the sampling pulse, and the held digital image signal is written in to the source signal line;

in the gate signal line driver circuit, a gate signal line selection pulse is output and the gate signal lines are selected sequentially from the first row; and in the plurality of pixels, write in of the n bit digital image signal sequentially from the first row is performed.

According to an eighteenth aspect of the present invention, a method of driving a liquid crystal display device displaying an image with an n bit digital image signal (n is an integer, where $2 \leqq n$) is characterized in that:

the liquid crystal display device comprises a gate signal line driver circuit, and a plurality of pixels;

in the source signal line driver circuit, a sampling pulse is output from a shift register and input to a latch circuit;

in the latch circuit, the digital image signal is held in accordance with the sampling pulse, and the held digital image signal is written in to the source signal line;

in the gate signal line driver circuit, a gate signal line selection pulse is output by specifying an arbitrary row of the gate signal lines, and in the plurality of pixels, write in of the n bit digital image signal is performed in an arbitrary row where the gate signal line is selected.

According to a nineteenth aspect of the present invention, in any one of the sixteenth to eighteenth aspects of the invention, the method of driving a liquid crystal display device is characterized in that, in a display period of a still image, the source signal line driver circuit is stopped by repeatedly reading the n bit digital image signal stored in the storage circuit to display the still image.

PREFERRED EMBODIMENTS OF THE PRESENT INVENTION

Figure 2:
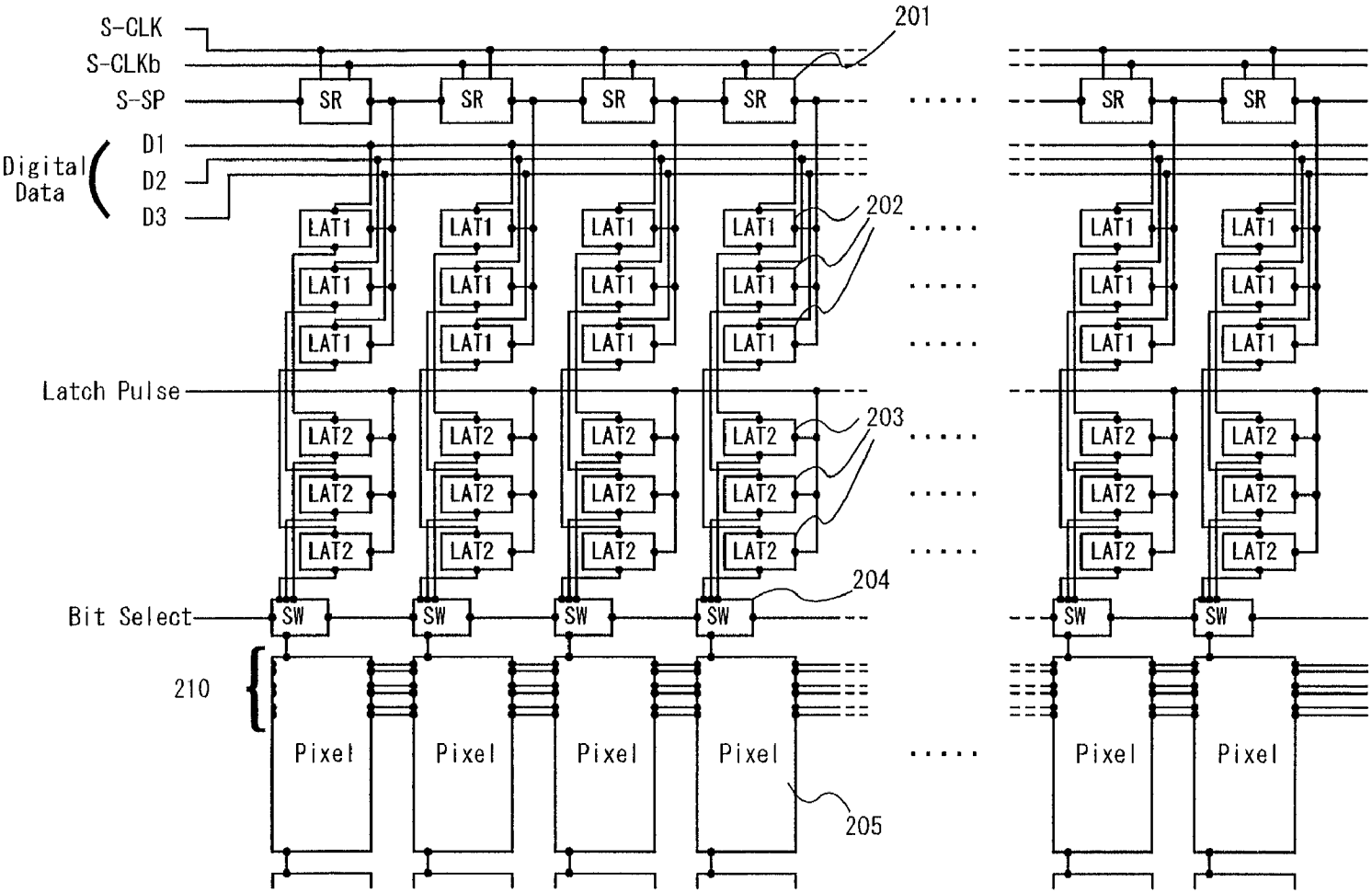
FIG. 2 shows a diagram of a circuit structure example of a source signal line driver circuit for performing display using a pixel in the present invention.

FIG. 2 shows a structure of a source signal line driver circuit and a portion of a pixel of a display device using the pixel having a plurality of storage circuits (memory circuits). This circuit corresponds to a 3 bit digital gray scale signal, and comprises shift register circuits 201, first latch circuits 202, second latch circuits 203, bit signal selection switches 204 and pixels 205. Reference numeral 210 are gate signal lines which are directly supplied from a gate signal line driver circuit or from outside, and which are input with gate signal line selection signals. This will be described later with an explanation of the pixel.

Figure 1:
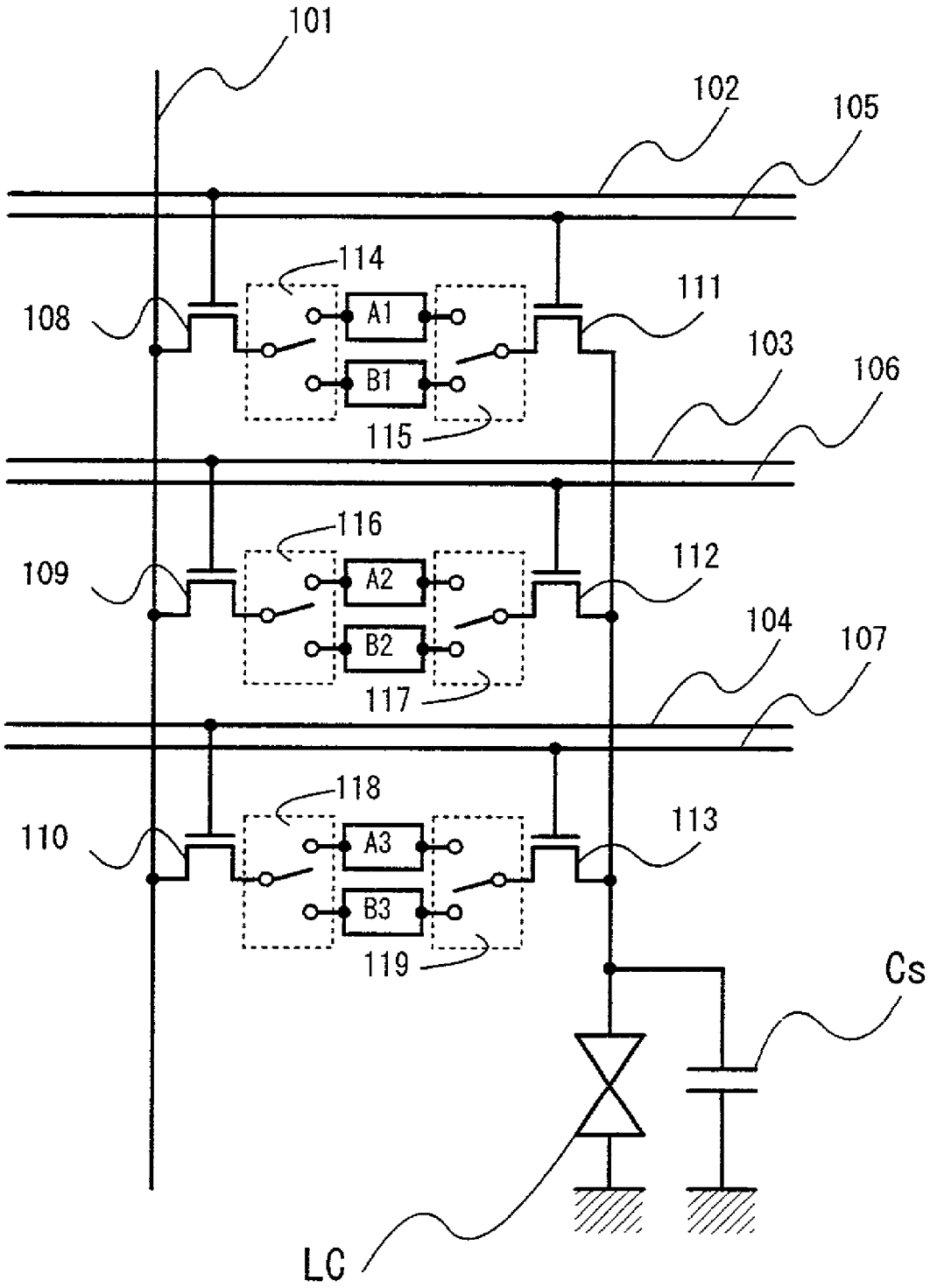
FIG. 1 shows a circuit diagram of a pixel of the present invention with a plurality of storage circuits inside.

FIG. 1 shows in detail a structure of the pixel 205 in FIG. 2. This pixel corresponds to a 3 bit digital gray scale, and is comprised of a liquid crystal element (LC), a storage capacitor (Cs), storage circuits (A1 to A3 and B1 to B3) or the like. Reference numeral 101 indicates a source signal line, reference numerals 102 to 104 indicate write-in gate signal lines, reference numerals 105 to 107 indicate read gate signal lines, reference numerals 108 to 110 indicate write in TFTs, reference numerals 111 to 113 indicate read TFTs, reference numeral 114 indicates a write-in storage circuit selection portion, reference numeral 115 indicates a first read storage circuit selection portion, reference numeral 116 indicates a write-in storage circuit selection portion, reference numeral 117 indicates a second read storage circuit selection portion, reference numeral 118 indicates a third write-in storage circuit selection portion, and reference numeral 119 indicates a third read storage circuit selection portion.

The storage circuits (A1 to A3 and B1 to B3) of the pixel shown in FIG. 1 may respectively store 1 bit digital image signals. Here, A1 to A3 are used as one set, and B1 to B3 are used as one set, and storing of 3 bit of digital image signals respectively is performed. That is, the pixel shown in FIG. 1 may store 3 bit of digital image signals for two frames.

FIG. 3 indicates a timing chart of a display device of the present invention shown in FIG. 1. The display device is intended for a 3 bit digital gray scale and VGA. The method of driving is explained referring to FIGS. 1 to 3. Note that, the reference numerals used in FIGS. 1 to 3 are used as is (the number of figures are omitted).

Figure 3A:
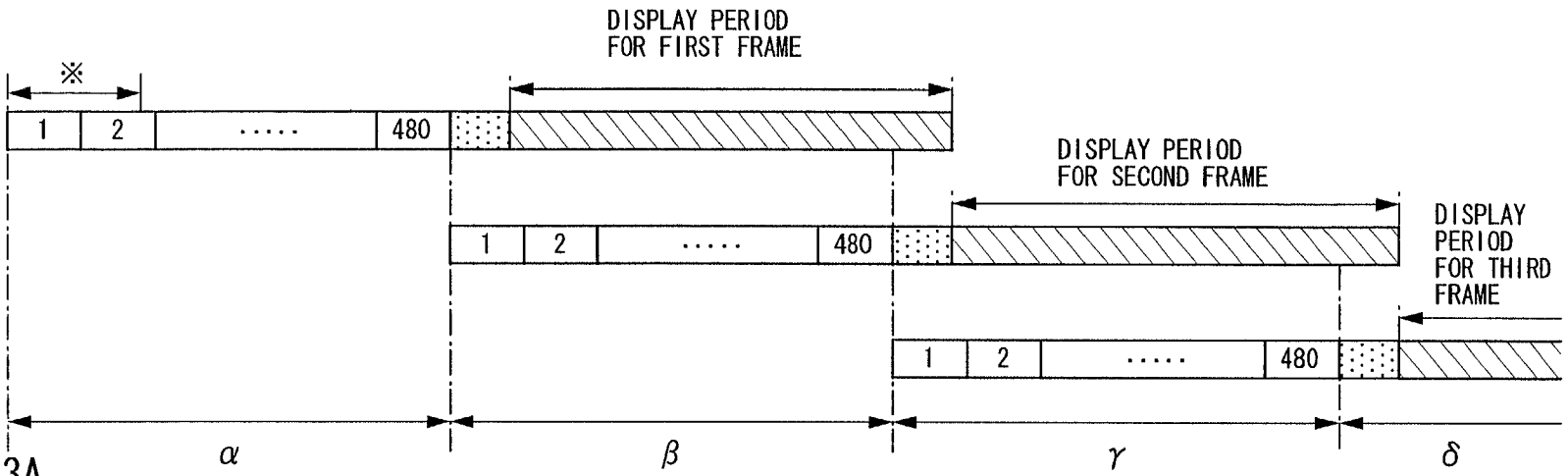
FIGS. 3A to 3C are diagrams showing timing charts for performing display using a pixel in the present invention.
Figure 3B:
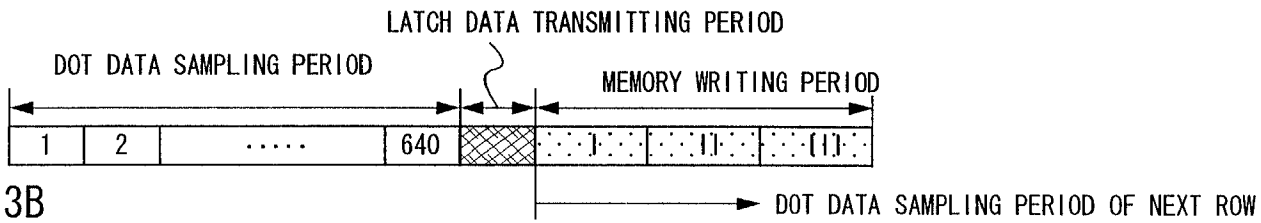

FIG. 2 and FIGS. 3A and 3B are referred to. Each frame period is shown as α, β, γ and δ and explained. First, the circuit operation is explained in a frame period α.

Similarly to a conventional case of a digital driving circuit, the shift register circuit 201 is input with a clock signal (S-CLK, S-CLKb) and a start pulse (S-SP), and sampling pulses are output sequentially. Subsequently, the sampling pulse is input to the first latch circuit 202 (LAT1), and a digital image signal (digital data) similarly input to the first latch circuit 202 are held respectively. A dot data sampling period for one horizontal period are respective periods shown as 1 to 480 in FIG. 3A. The digital image signal is 3 bit and D1 is MSB (most significant bit) and D3 is LSB (least significant bit). When holding the digital image signal for one horizontal period is completed in the first latch circuit 202, in a retrace period, the digital image signals held in the first latch circuit 202 are transferred at once to the second latch circuit 203 (LAT2) in accordance with the input of a latch signal (latch pulse).

Subsequently, again in accordance with the sampling pulse output from the shift register circuit 201, the holding operation for the next horizontal period is conducted.

On the other hand, the digital image signal transferred to the second latch circuit 203 is written in to the storage circuit arranged in the pixel. As shown in FIG. 3B, the dot data sampling period of the next row is divided in three as I, II and III, and the digital image signal held in the second latch circuit is output to the source signal line. At this time, the signals of each bit are selectively connected to be output to the source signal line in order by the bit signal selection switch 204.

In the period I, the pulse is input to the write-in gate signal line 102, the write in TFT 108 becomes in continuity, the storage circuit selection portion 114 selects the storage circuit A1, and the digital image signal is written in to the storage circuit A1. Subsequently, in the period II, the pulse is input to the write-in gate signal line 103, the write in TFT 109 becomes in continuity, the write-in storage circuit selection portion 116 selects the storage circuit A2, and the digital image signal is written in to the storage circuit A2. Lastly, in the period III, the pulse is input to the write-in gate signal line 104, the write in TFT 110 becomes in continuity, the storage circuit selection portion 118 selects the storage circuit A3, and the digital image signal is written in the storage circuit A3.

With the above, the process for the digital image signal for one horizontal period is completed. The period in FIG. 3B is the period shown by ·X· in FIG. 3A. By performing the above operations until the final stage, the digital image signal for one frame is written in to the storage circuit A.

By the way, the display device of the present invention expresses 3 bit digital gray scale by the time gray scale method. The time gray scale method, different to the normal method for performing brightness control by the voltage applied to the pixel, and obtains a gray scale by making use of a display time difference using two states of ON and OFF (white and black on the display) by applying only two kinds of voltages to the pixel. When performing an n bit gray scale display in the time gray scale method, the display period is divided into n periods, and the ratio of the lengths of each period is 2 squared such as $2^{n-1}2^{n-2}: \ldots :2^0$, and the difference in the display period length is generated by determining in which period the pixel is turned ON. Thus, the display of gray scale is conducted. Note that, the state here that the pixel is turned ON, is the state where the voltage is applied, and the state that the pixel is turned OFF, is the state where the voltage is not applied. Hereafter, such states are shown as ON and OFF.

Further, display is possible by gray scale display in a partition other than where the display period length is 2 squared.

Figure 3C:
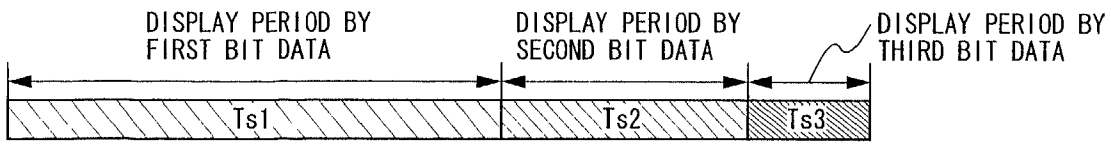

In view of the above, the operation in the frame period β is explained. When the write in to the storage circuit in the last stage is completed, the display for the first frame is conducted. FIG. 3C is a diagram explaining the 3 bit time gray scale method. At present, the digital image signal is stored in storage circuits A1 to A3 for each bit. Ts1 is a display period with the first bit data, Ts2 is a display period with the second bit data, and Ts3 is a display period with the third bit data. The length of each display period is Ts1:Ts2:Ts3=4:2:1.

Since it is 3 bit here, the brightness may have eight stages of 0 to 7. If display is not performed in any of the period Ts1 to Ts3, the brightness is 0, and if display is performed using all periods, the brightness is 7. For example, if the brightness 5 is to be displayed, display should be performed with the pixel in an ON state in the period Ts1 to Ts3.

Specifically, explanation is performed referring to the figures. In Ts1, the pulse is input to the read gate signal line 105, the read TFT 111 becomes in continuity, the storage circuit selection portion 115 selects the storage circuit A1, and the pixel is driven according to the digital image signal stored in the storage circuit A1. Subsequently, in Ts2, the pulse is input to the read gate signal line 106, the read TFT 112 becomes in continuity, the storage circuit selection portion 117 selects the storage circuit A2, and the pixel is driven according to the digital image signal stored in the storage circuit A2. Lastly, in Ts3, the pulse is input to the read gate signal line 107, the read TFT 113 becomes in continuity, the storage circuit selection portion 119 selects the storage circuit A3, and a voltage is applied to the pixel according to the digital image signal stored in the storage circuit A3.

Here, in the case of the liquid crystal display device, there are a normally white mode and a normally black mode. In both cases, since white and black become opposite in the ON and OFF of the pixel, there may be a case where the brightness becomes opposite to that in the above explanation.

In this way, display for one frame period is performed. On the other hand, at the driver circuit side, processing of the digital image signal of the next frame period is performed at the same time. Until the transfer of the digital image signal to the second latch circuit, it is the same procedure as described above. In the next write in period to the storage circuit, a different storage circuit to that storing the digital image signal in the preceding frame period is used.

In the period I, the pulse is input to the write-in gate signal line 102, the write in TFT 108 becomes in continuity, the storage circuit selection portion 114 selects the storage circuit B1, and a digital image signal is written in to the storage circuit B1. Next, in the period II, the pulse is input to the write-in gate signal line 103, the write in TFT 109 becomes in continuity, the storage circuit selection portion 116 selects the storage circuit B2, and the digital image signal is written in to the storage circuit B2. Lastly, in the period III, the pulse is input to the write-in gate signal line 104, the write in TFT 110 becomes in continuity, the storage circuit selection portion selects the storage circuit B3, and the digital image signal is written in to the storage circuit B3.

Subsequently, in the frame period y, display for the second frame is performed in accordance with the digital image signal stored in the storage circuits B1 to B3. At the same time, processing of the digital image signal for the next frame period is started. This digital image signal is again stored in the storage circuits A1 to A3 with which display for the first frame is completed.

Thereafter, display of digital image signal stored in the storage circuits A1 to A3 is performed in the frame period 6, and the processing of the digital image signal in the next frame period starts at the same time. This digital image signal is again stored in the storage circuits B1 to B3 with which display for the second frame is complete.

The above operations are repeated to continuously perform the display of the image. Here, in the case a still image is displayed, when the digital image signal is once stored in the storage circuits A1 to A3 in the first operation, the digital image signal stored in the storage circuits A1 to A3 in each frame period may be recurrently read. Accordingly, during the period that this still image is displayed, the drive of the source signal line driver circuit may be stopped.

Further, the write in of the digital image signal to the storage circuit, or the reading of the digital image signal from the storage circuit may be performed for each one of the gate signal lines. That is, in only the line which needs rewriting of the screen, a display method such as, selecting the gate signal line, operating the source signal line driver circuit for only a short period of time, and rewriting only a portion of the screen may be performed.

Further, in this embodiment mode, one pixel comprises storage circuits A1 to A3 and B1 to B3, and has a function of storing 3 bit digital image signals for two frames, however the present invention is not limited to this number. That is, to store the n bit digital image signal for m frames, one pixel may comprise n×m storage circuits.

With the above method, by performing the storing of the digital image signal using a storage circuit mounted in the pixel, the digital image signal stored in the storage circuit in each frame period when displaying the still image is recurrently used, and the still image display may be continuously performed without having to drive the source signal line driver circuit. Thus greatly contributing to the low power consumption of the liquid crystal display device.

Further, regarding the source signal line driver circuit, from the view point of a problem of arranging the latch circuit or the like which increases in accordance with the bit number, the source signal line driver circuit does not necessarily have to be integrally formed on the insulator, but a portion or the whole thereof may be structured externally.

Further, the source signal line driver circuit shown in this embodiment mode arranges the latch circuit in accordance with the bit number, but it is possible to operate by arranging only for 1 bit. In this case, the digital image signal from the most significant bit to the least significant bit may be input to the latch circuit in a series.

Hereinbelow, embodiments of the present invention will be described.

[Embodiment 1]

In this embodiment, the memory circuit selection portion in the circuit described in the mode for carrying out the invention is specifically constructed by using transistors and the like, and the operation will be described.

Figure 4A:
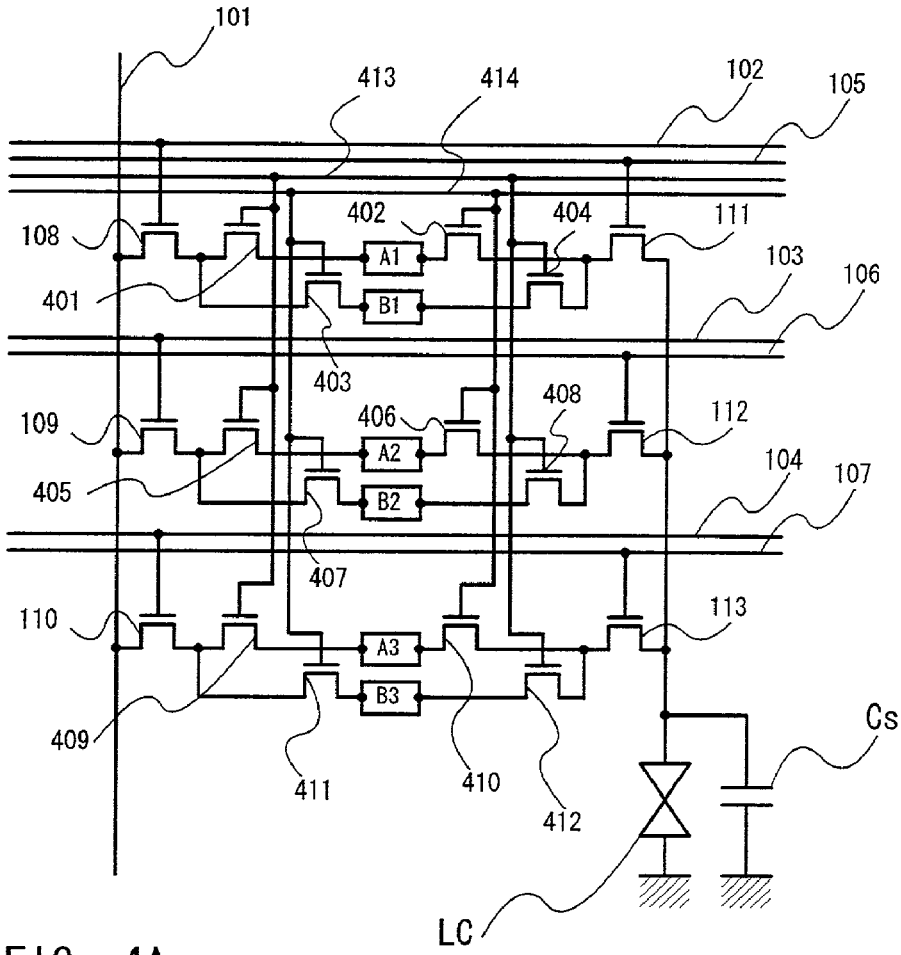
FIGS. 4A and 4B show detailed circuit diagrams of a pixel of the present invention with a plurality of storage circuits inside.

FIG. 4A shows an example similar to the pixel shown in FIG. 1 and the memory circuit selection portions 114 to t 19 are actually constructed by circuits. In the drawings, with respect to the numbers given to the respective portions, the same portions as those of FIG. 1 are given the same numbers as those of FIG. 1. Writing selection TFTs 401, 403, 405, 407, 409 and 411, and reading selection TFTs 402,404, 406, 408, 410 and 412 are provided in memory circuits A1 to A3 and B1 to B3, and are controlled by memory circuit selection signal lines 413 and 414.

Figure 4B:
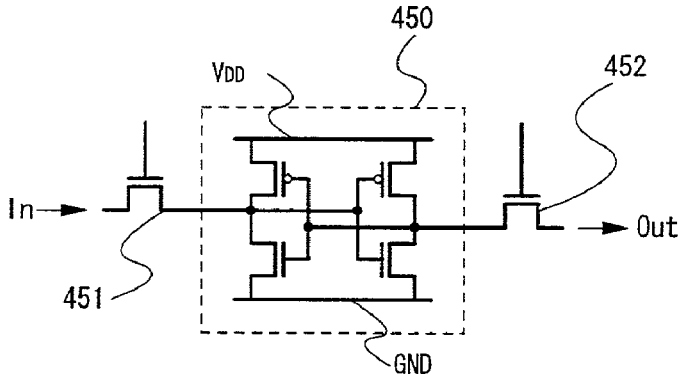

FIG. 4B shows an example of the memory circuit. A portion indicated by a dotted line frame 450 is a memory circuit (portion indicated by A1 to A3 and B1 to B3 in FIG. 4A). Reference numeral 451 designates a writing selection TFT; and 452, a reading selection TFT. In the memory circuit shown here, although a static memory (Static RAM: SRAM) made of two inverters connected into a loop is used, the memory circuit is not limited to this structure. Here, in the case where the SRAM is used for the memory circuit, the pixel may be made to have a structure which does not include a holding capacitance (Cs).

In this embodiment, driving of the circuit shown in FIG. 4A can be made in accordance with the timing charts shown in FIGS. 3A to 3C in the mode for carrying out the invention. The circuit operation, together with an actual driving method of the memory circuit selection portion, will be described with reference to FIGS. 3A to 3C and FIG. 4A. Further, the respective numbers in FIGS. 3A to 3C and FIG. 4A are used as they are (drawing number is omitted).

Reference will be made to FIGS. 3A and 3B. In FIG. 3A, respective frame periods are denoted by α, β, γ and δ, and the explanation will be given. First, the circuit operation in the frame period α will be described.

Since a driving method from the shift registers to the second latch circuits is the same as that shown in the mode for carrying out the invention, the method obeys that.

First, a pulse is input to the memory circuit selection signal line 413, the writing selection TFTs 401, 405 and 409 are turned on, and a state is obtained in which writing into the memory circuits A1 to A3 is enabled. In the period I, a pulse is input to the writing gate signal line 102, the TFT 108 is turned on, and the digital image signal is written into the memory circuit A1. Subsequently, in the period II, a pulse is input to the writing gate signal line 103, the writing TFT 109 is turned on, and the digital image signal is written into the memory circuit A2. Finally, in the period III, a pulse is input to the writing gate signal line 104, the writing TFT 110 is turned on, and the digital image signal is written into the memory circuit A3.

Here, the processing of the digital image signals for one horizontal period is completed. The period of FIG. 3B is a period indicated by the asterisk * in FIG. 3A. The above operation is carried out to the final stage, so that the digital image signals for one frame are written in the memory circuits A1 to A3.

Subsequently, the operation in the frame period β will be described. When writing into the memory circuits at the final stage is ended, a display of the first frame is carried out. FIG. 3C is a view for explaining the 3-bit time gradation system. Now, the digital image signals for respective bits are stored in the memory circuits A1 to A3. Reference character Ts1 designates a display period by first bit data; Ts2, a display period by second bit data; and Ts3, a display period by third bit data. The lengths of the respective display periods are Ts1:Ts2:Ts3=4:2:1.

However, even if the length of the display period is divided into periods other than the powers of 2 to carry out a gradation display, a display is enabled.

Here, since three bits are used, eight stages of 0 to 7 can be obtained for the brightness. In the case where a display is not carried out in any periods of Ts1 to Ts3, the brightness is 0, and when a display is carried out using all periods, the brightness is 7. For example, in the case where the brightness 5 is desired to be displayed, a display has only to be carried out in such a state that the pixel is made to have the ON state in the display periods Ts1 and Ts3.

The description will be specifically given with reference to the drawings. After the writing operation to the memory circuits is ended, when it proceeds to a display period, the pulse which has been input to the memory circuit selection signal line 413 is ended, and at the same time, a pulse is input to the memory circuit selection signal line 414, the writing TFTs 401, 405, and 409 are turned off, the reading TFTs 402, 406 and 410 are turned on, and there occurs such a state that reading from the memory circuits A1 to A3 is enabled. In the display period Ts1, a pulse is input to the reading gate signal line 105, the reading TFT 111 is turned on, and the pixel lights up in accordance with the digital image signal stored in the memory circuit A1. Subsequently, in the display period Ts2, a pulse is input to the reading gate signal line 106, the reading TFT 112 is turned on, and the pixel lights up in accordance with the digital image signal stored in the memory circuit A2. Finally, in the display period Ts3, a pulse is input to the reading gate signal line 107, the reading TFT 113 is turned on, and the pixel lights up in accordance with the digital image signal stored in the memory circuit A3.

In the manner as described above, a display for one frame period is carried out. On the other hand, at the side of the driving circuit, the processing of digital image signals of a next frame period is carried out at the same time. The procedure up to the transfer of the digital image signals to the second latch circuits is the same as the above. In a subsequent writing period into memory circuits, the memory circuits B1 to B3 are used.

Note that, in the periods in which the signals are written into the memory circuits A1 to A3, although the writing TFTs 401, 405, and 409 to the memory circuits A1 to A3 are turned on, at the same time, the reading TFTs 404, 408 and 412 from the memory circuits B1 to B3 are also turned on. Similarly, when the reading TFTs 402, 406, and 410 from the memory circuits A1 to A3 are turned on, at the same time, the writing TFTs 403, 407 and 411 to the memory circuits B1 to B3 are also turned on, and in the mutual memory circuits, writing and reading are alternately carried out in a certain frame period.

In the period I, a pulse is input to the writing gate signal line 102, the TFT 108 is turned on, and the digital image signal is written into the memory circuit B1. Subsequently, in the period II, a pulse is input to the writing gate signal line 103, the is TFT 109 is turned on, and the digital image signal is written into the memory circuit B2. Finally, in the period III, a pulse is input to the writing gate signal line 104, the TFT 110 is turned on, and the digital image signal is written into the memory circuit B3.

Subsequently, in the frame period γ, a display of the second frame is carried out in accordance with the digital image signals stored in the memory circuits B1 to B3. At the same time, the processing of digital image signals of a next frame period is started. The digital image signals are again stored in the memory circuits A1 to A3 in which the display of the first frame is completed.

Thereafter, a display of the digital image signals stored in the memory circuits A1 to A3 is carried out in the frame period δ, and at the same time, the processing of digital image signals of a next frame period is started. The digital image signals are again stored in the memory circuits B1 to B3 in which the display of the second frame is completed.

The above procedure is repeated, and a display of an image is carried out. Incidentally, in the case where a still picture is displayed, after writing of the digital image signals of a certain frame into the memory circuits is completed, the source signal line driving circuit is stopped, the signals stored in the same memory circuits are read out for each frame, and a display is carried out. By the method like this, electric power consumption during the display of the still picture can be greatly reduced.

[Embodiment 2]

In this embodiment, a description will be given of an example in which writing into memory circuits of a pixel portion is carried out in dot sequence, so that second latch circuits of a source signal line driving circuit are omitted.

Figure 5:
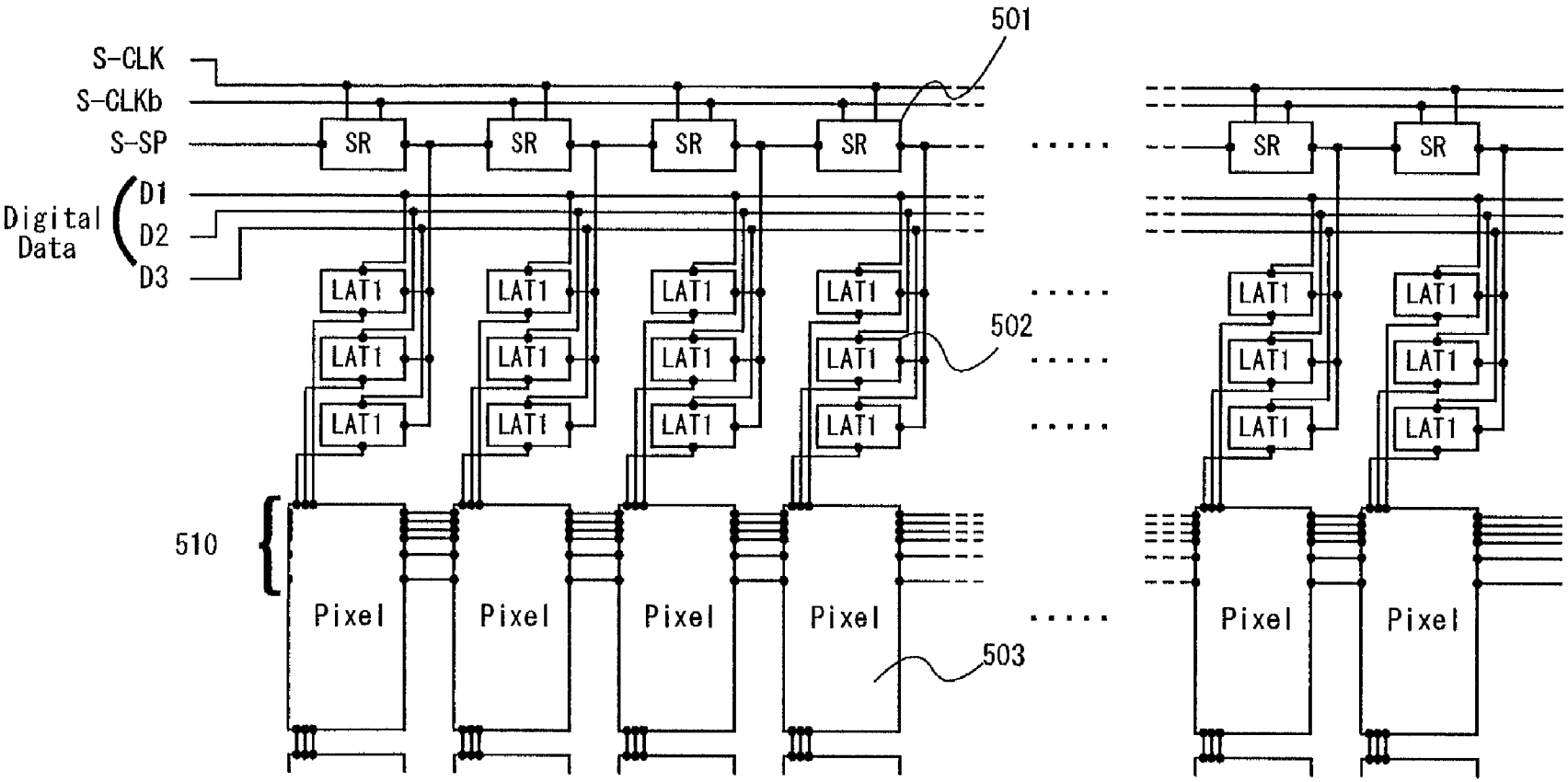
FIG. 5 is a diagram showing a circuit structure example of a source signal line driver circuit without a second latch circuit.

FIG. 5 shows a structure of a source signal line driving circuit and some pixels in a liquid crystal display device using a pixel including memory circuits. This circuit corresponds to a 3-bit digital gradation signal, and includes shift register circuits 501, latch circuits 502, and pixels 503. Reference numeral 510 designates a signal supplied from a gate signal line driving circuit or directly from the outside, and is described later together with the description of the pixel.

Figure 6:
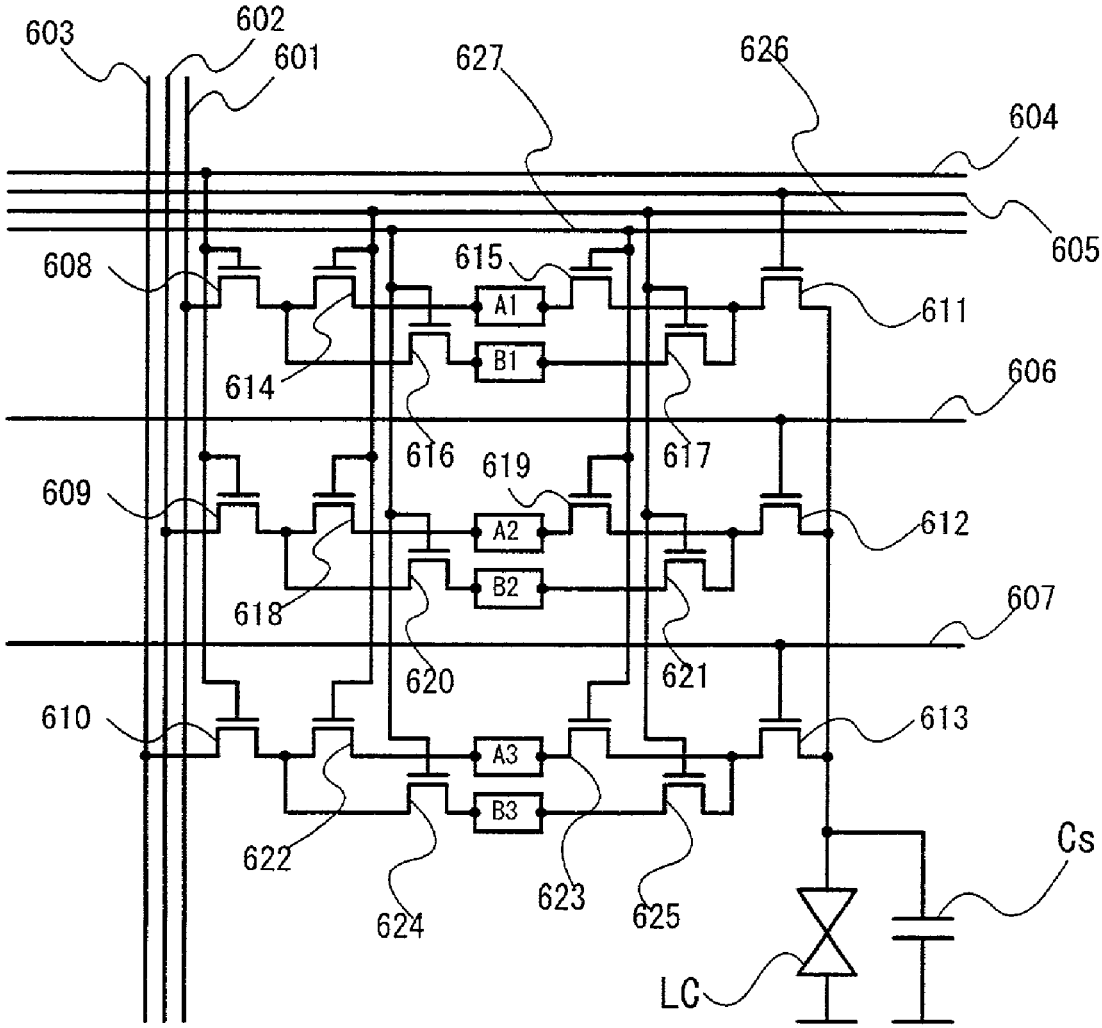
FIG. 6 is a detailed circuit diagram of a pixel driven by a source signal line driver circuit in FIG. 5.
Figure 20:
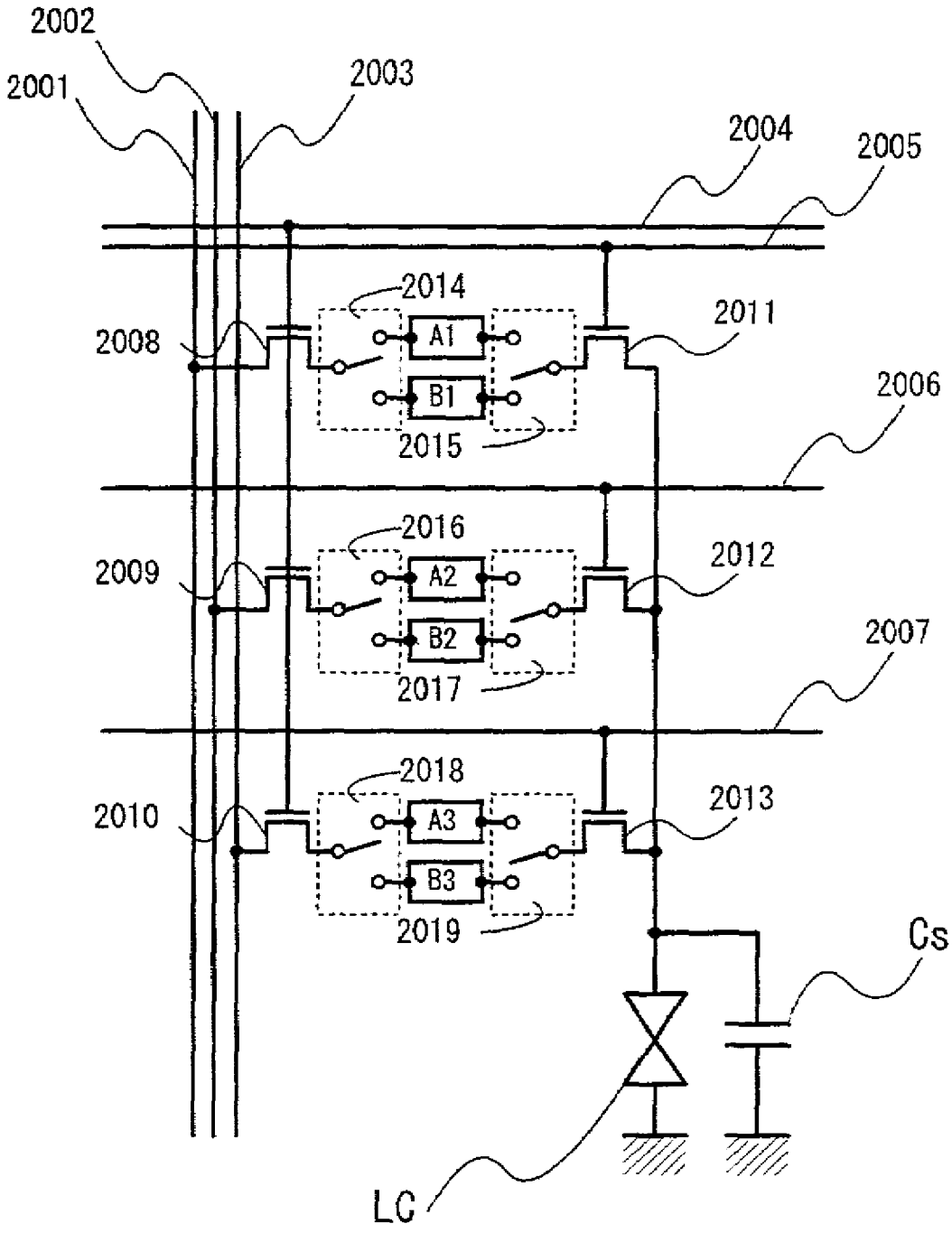
FIG. 20 is a circuit diagram of a pixel driven by the source signal line driver circuit in FIG. 5.

FIG. 20 is a detailed view of a circuit structure of the pixel 503 shown in FIG. 5. Similarly to the embodiment 1, this pixel corresponds to 3-bit digital gradation, and includes a plurality of memory circuits (A1 to A3 and B1 to B3). FIG. 6 shows a structure in which writing memory circuit selection portions 2014 2016, and 2018 and reading memory circuit selection portions 2015, 2017, and 2019 are constructed similarly to the embodiment 1. Reference numeral 601 designates a source signal line for a first bit (MSB) signal; 602, a source signal line for a second bit signal; 603; a source signal line for a third bit (LSB) signal; 604, a writing gate signal line; 605 to 607, reading gate signal lines; 608 to 610, writing TFTs; and 611 to 613, reading TFTs. The memory circuit selection portion is constructed by using writing selection TFTs 614, 616, 618, 620, 622, and 624 and reading selection TFTs 615, 617, 619, 621, 623, and 625, and the like. Reference numerals 626 and 627 designate memory circuit selection signal lines.

Figure 7A:
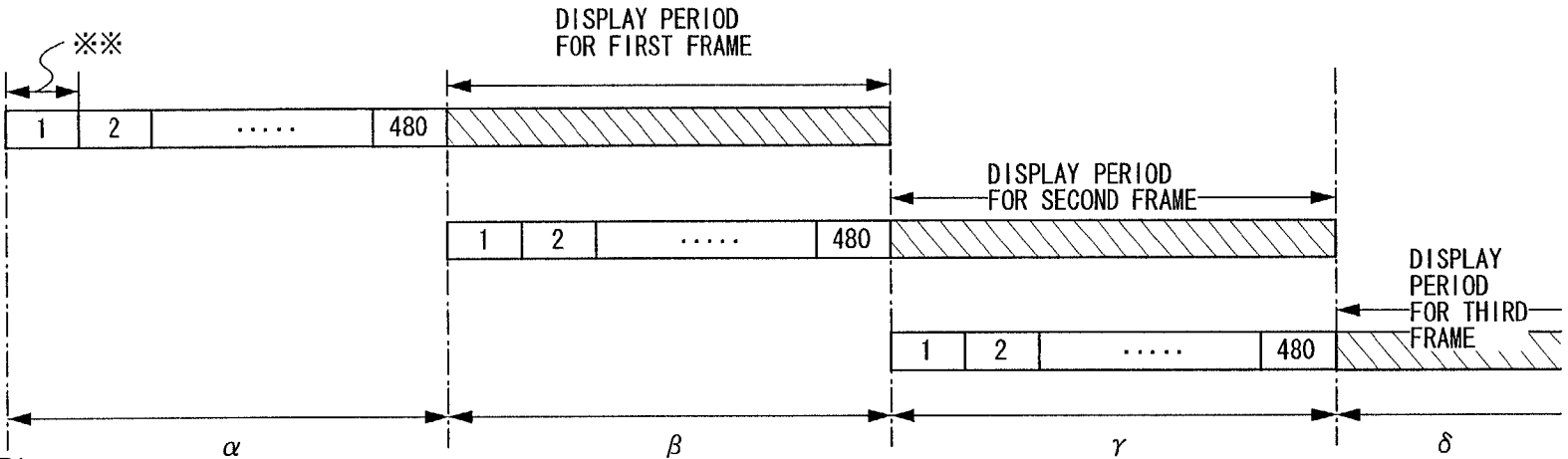
FIGS. 7A to 7C are diagrams showing timing charts for performing display using the circuit described in FIGS. 5 and 6.
Figure 7B:
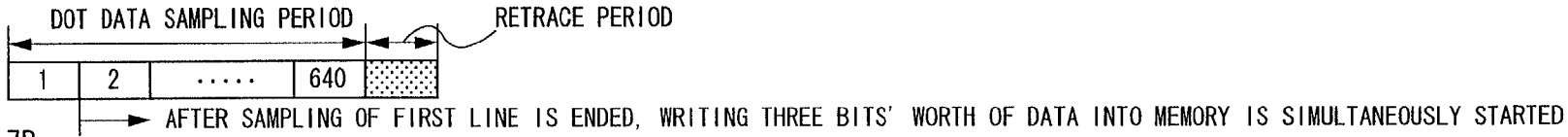
Figure 7C:
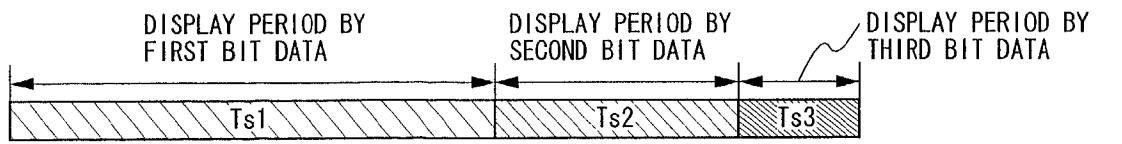

FIGS. 7A to 7C are timing charts with respect to the driving of the circuit shown in this embodiment. The description will be given with reference to FIG. 6 and FIGS. 7A to 7C.

The operation from the shift register circuits 501 to the latch circuits (LAT 1) 502 is carried out similarly to the mode for carrying out the invention and the embodiment 1. As shown in FIG. 7B, when the latch operation at the first stage is ended, writing into the memory circuits of the pixel is immediately started. A pulse is inputted to the writing gate signal line 604, the writing TFTs 608 to 610 are turned on, and further, a pulse is inputted to the memory circuit selection signal line 626, the writing selection TFTs 614, 618, and 622 are turned on, and there occurs such a state that writing into the memory circuits A1 to A3 is enable. The digital image signals for the respective bits held in the latch circuits 502 are simultaneously written through the three source signal lines 601 to 603.

When the digital image signals held in the latch circuits is being stored into the memory circuits at the first stage, at the next stage, the digital image signals are held in the latch circuits in accordance with sampling pulses. In this way, writing into the memory circuits is sequentially carried out.

The above is carried out in one horizontal period (period indicated by * * in FIG. 7A), and is repeated a predetermined number of times, the number being equal to the number of the gate signal lines, and when writing of the digital image signals for one frame in the frame period $\alpha$ into the memory circuits is ended, the procedure proceeds to the display period of the first frame indicated by the frame period $\beta$. The pulse which has been inputted to the writing gate signal line 604 is stopped, and further, the pulse which has been inputted to the memory circuit selection signal line 626 is stopped, and instead thereof, a pulse is inputted to the memory circuit selection signal line 627, the readout selecting TFTs 615, 619, and 623 are turned on, and there occurs such a state that reading from the memory circuits A1 to A3 is enabled.

Subsequently, by the time gradation system described in the mode for carrying out the invention, the embodiment 1 and so on, as shown in FIG. 7C, in the display period Ts1, a pulse is inputted to the reading gate signal line 605, the reading TFT 611 is turned on, and a display is carried out by the digital image signal written is in the memory circuit A1. Subsequently, in the display period Ts2, a pulse is inputted to the reading gate signal line 606, the reading TFT 612 is turned on, and a display is carried out by the digital image signal written in the memory circuit A2. Similarly, in the display period Ts3, a pulse is inputted to the reading gate signal line 607, the reading TFT 613 is turned on, and a display is carried out by the digital image signal written in the memory circuit A3.

Here, the display period of the first frame is completed. In the frame period $\beta$, the processing of digital image signals in a next frame is carried out at the same time. The procedure similar to the foregoing is carried out up to the holding of the digital image signals in the latch circuits 502. In a subsequent writing period into memory circuits, the memory circuits B1 to B3 are used.

Incidentally, in the period when signals are written into the memory circuits A1 to A3, although the writing TFTs 614, 618 and 622 to the memory circuits A1 to A3 are turned on, the reading TFTs 617, 621, and 625 from the memory circuits B1 to B3 are also turned on at the same time. Similarly, when the reading TFTs 615, 619 and 623 from the memory circuits A1 to A3 are turned on, the writing TFTs 616, 620 and 624 to the memory circuits B1 to B3 are also turned on at the same time, and writing and reading are alternately carried out in a certain frame period in the mutual memory circuits.

The writing operation and reading operation to the memory circuits B1 to B3 are the same as those of the memory circuits A1 to A3. When the writing into the memory circuits B1 to B3 is ended, the frame period E starts, and the display period of a second frame starts. Further, in this frame period, the processing of digital image signals in a next frame is carried out. The procedure similar to the foregoing is carried out up to the holding of the digital image signals in the latch circuit 502. In the subsequent writing period into memory circuits, the memory circuits A1 to A3 are again used.

Thereafter, a display of the digital image signals stored in the memory circuits A1 to A3 is carried out in the frame period 6, and at the same time, the processing of digital image signals in a next frame period is started. The digital image signals are again stored in the memory circuits B1 to B3 in which the display of the second frame is completed.

The above procedure is repeated, so that an image is displayed. Incidentally, in the case where a display of a still picture is carried out, when writing of digital image signals of a certain frame into the memory circuits is completed, the source signal line driving circuit is stopped, the signals written in the same memory circuits are read out in each frame, and a display is carried out. By the method like this, electric power consumption during the display of the still picture can be greatly reduced. Further, when compared with the circuit described in the embodiment 1, the number of latch circuits can be made a half, which contributes to the miniaturization of the whole device by reduction in space of the circuit arrangement.

[Embodiment 3]

In this embodiment, a description will be given of an example of a liquid crystal display device which uses the circuit structure of a liquid crystal display device in which the second latch circuits are omitted, as described in the embodiment 2, and uses a method of carrying out writing into memory circuits in a pixel by linear sequential driving.

Figure 17:
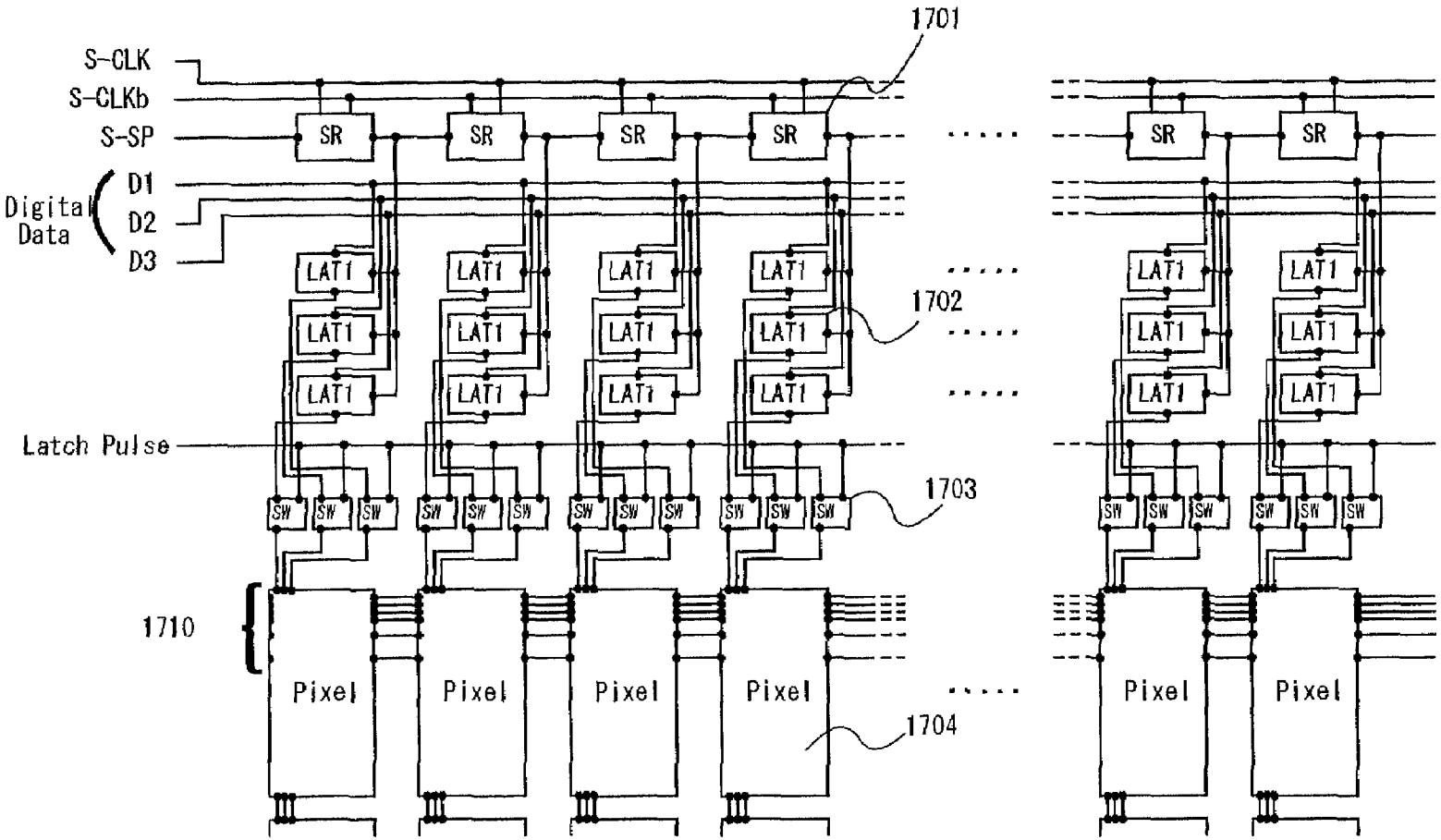
FIG. 17 is a diagram showing a circuit structure example of a source signal line driver circuit without a second latch circuit.

FIG. 17 shows a circuit structural example of a source signal line driving circuit of a liquid crystal display device to be described in this embodiment. This circuit corresponds to a 3-bit digital gradation signal, and includes shift register circuits 1701, latch circuits 1702, switch circuits 1703, and pixels 1704. Reference numeral 1710 designates a signal supplied from a gate signal line driving circuit or directly from the outside. Since a circuit structure of a pixel may be the same as that of the embodiment 2, reference will be made to FIG. 6 as it is.

Figure 18A:
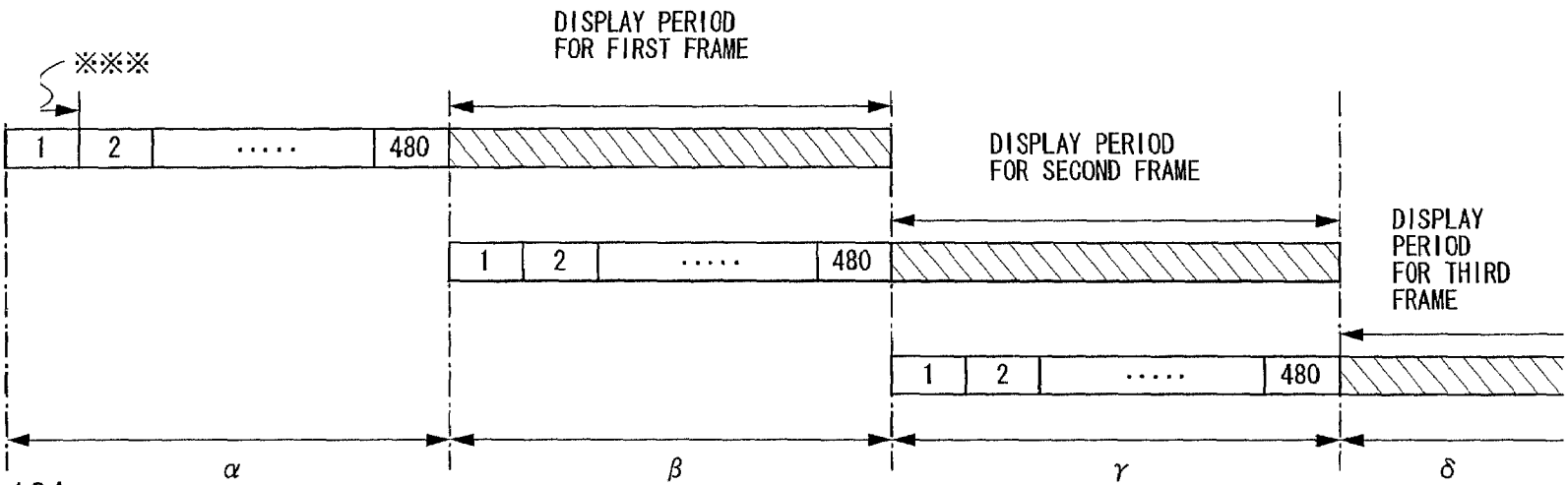
FIGS. 18A to 18C are diagrams showing timing charts for performing display using the circuit described in FIG. 17.
Figure 18B:
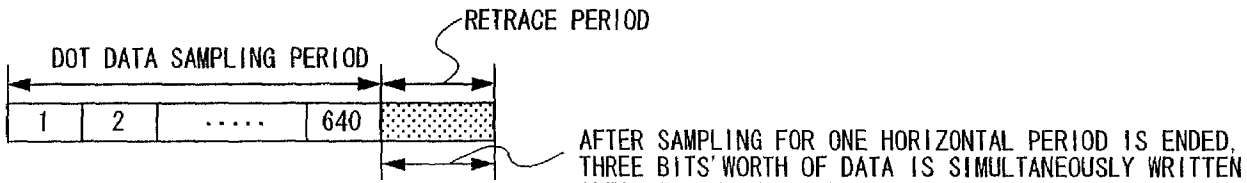
Figure 18C:
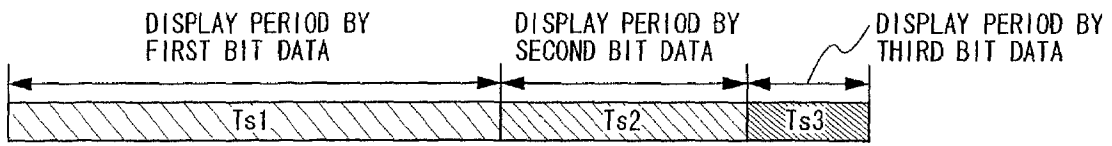

FIGS. 18A to 18C are timing charts with respect to the driving of the circuit described in this embodiment. The description will be given with reference to FIG. 6, FIG. 17 and FIGS. 18A to 18C.

The operation in which sampling pulses are outputted from the shift register circuits 1701 and digital image signals are held in the latch circuits 1702 in accordance with the sampling pulses, is the same as in the embodiments 1 and 2. In this embodiment, since the switch circuits 1703 are provided between the latch circuits 1702 and the memory circuits in the pixels 1704, even if holding of the digital image signals in the latch circuits is completed, writing into the memory circuits is not immediately started. The switch circuits 1703 remain closed till a dot data sampling period is completed, and the latch circuits continue to hold the digital image signals.

As shown in FIG. 18B, when holding of the digital image signals for one horizontal period is completed, a latch signal (Latch Pulse) is inputted in a subsequent retrace period, the switch circuits 1703 are opened all at once, and the digital image signals held in the latch circuits 1702 are written into the memory circuits in the pixels 1704 all at once. Since the operation in the pixels 1704 with respect to the writing operation at this time, and the operation in the pixels 1704 with respect to the re-reading operation of a display in a next frame period may be the same as in the embodiment 2, the description is omitted here.

By the above method, even in the source signal line driving circuit in which the latch circuits are omitted, the linear sequential writing can be easily carried out.

[Embodiment 4]

In Embodiment 4, a method of simultaneously manufacturing TFTs of driver circuit portions provided in the pixel portion and the periphery thereof (a source signal line driver circuit, a gate signal line driver circuit and a pixel selective driver circuit). However, in order to simplify the explanation, a CMOS circuit, which is the basic circuit for the driver circuit, is shown in the figures.

Figures 10A, 10B, 10C:
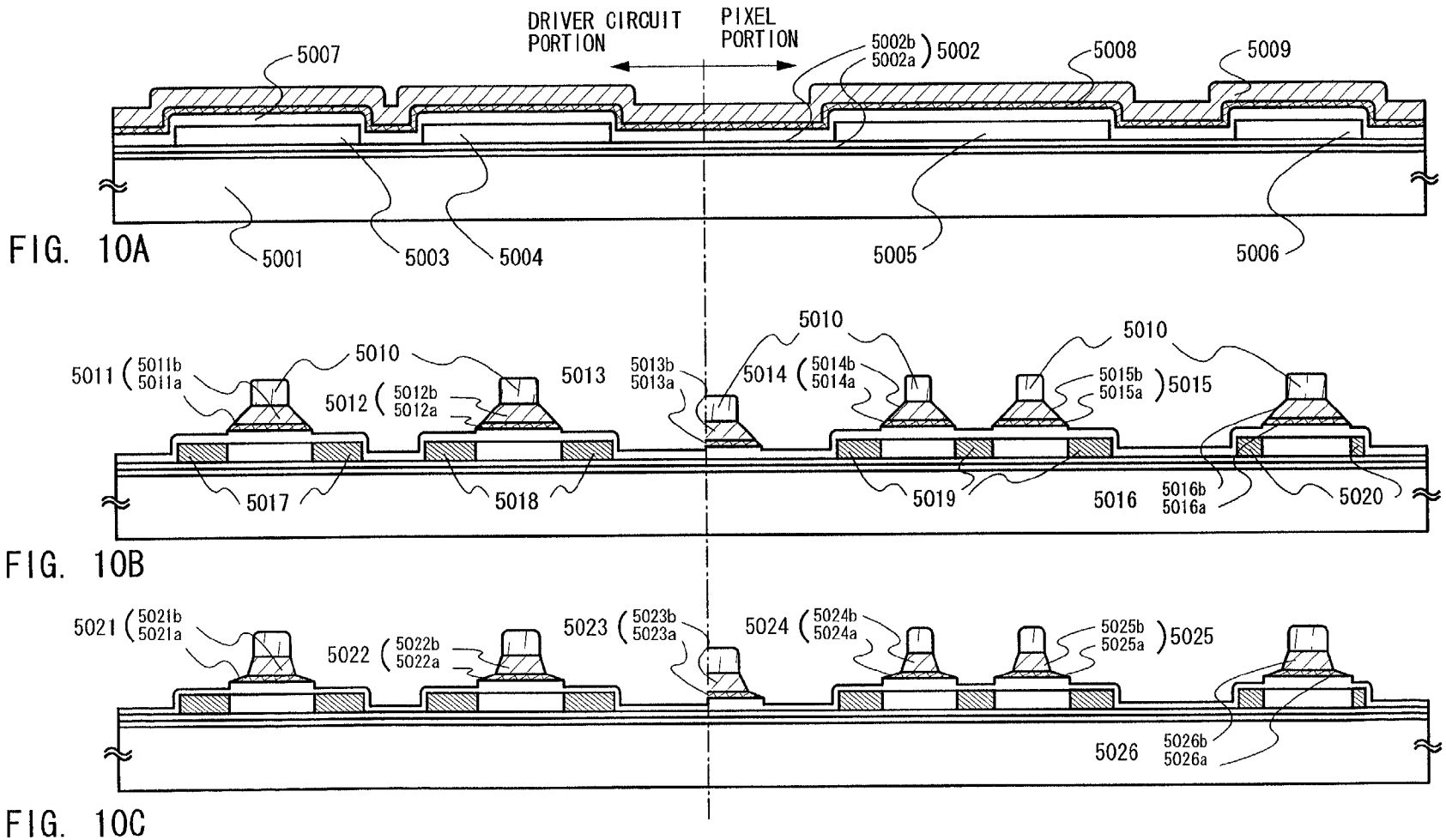
FIGS. 10A to 10C are diagrams showing examples of manufacturing steps of a liquid crystal display device with a pixel of the present invention.

First, as shown in FIG. 10A, a base film 5002 made of an insulating film such as a silicon oxide film, a silicon nitride film, or a silicon nitride oxide film is formed on a substrate 5001 made of glass such as barium borosilicate glass or alumino borosilicate glass, typified by #7059 glass or #1737 glass of Corning Inc. For example, a silicon nitride oxide film 5002*a* fabricated from $SiH_4$, $NH_3$ and $N_2O$ by a plasma CVD method is formed with a thickness of 10 to 200 nm (preferably 50 to 100 nm), and a hydrogenated silicon nitride oxide film 5002*b* similarly fabricated from $SiH_4$ and $N_2O$ is formed with a thickness of 50 to 200 nm (preferably 100 to 150 nm) to form a lamination. In Embodiment 4, although the base film 5002 is shown as the two-layer structure, the film may be formed of a single layer film of the foregoing insulating film or as a lamination structure of more than two layers.

Island-like semiconductor layers 5003 to 5006 are formed of a crystalline semiconductor film manufactured by using a laser crystallization method on a semiconductor film having an amorphous structure, or by using a known thermal crystallization method. The thickness of the island-like semiconductor films 5003 to 5006 is set from 25 to 80 nm (preferably between 30 and 60 nm). There is no limitation on the crystalline semiconductor film material, but it is preferable to form the film from a silicon or a silicon germanium (SiGe) alloy.

A laser such as a pulse oscillation type or continuous emission type excimer laser, a YAG laser, or a $YVO_4$ laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 30 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may beset from 300 to 600 mJ/cm$^2$ (typically between 350 and 500 mJ/cm$^2$). The laser light which has been condensed into a linear shape with a width of 100 to 1000 $\mu$m, for example 400 $\mu$m, is then irradiated over the entire surface of the substrate. This is performed with an overlap ratio of 80 to 98%.

Next, a gate insulating film 5007 is formed covering the island-like semiconductor films 5003 to 5006. The gate insulating film 5007 is formed of an insulating film containing silicon with a thickness of 40 to 150 nm by a plasma CVD method or a sputtering method. A 120 nm thick silicon nitride oxide film is formed in Embodiment 4. The gate insulating film is not limited to such a silicon nitride oxide film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56 MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5008 and a second conductive film 5009 are then formed on the gate insulating film 5007 in order to form gate electrodes. In Embodiment 4, the first conductive film 5008 is formed from Ta with a thickness of 50 to 100 nm, and the second conductive film 5009 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of an $\alpha$ phase Ta film is on the order of 20 $\mu\Omega$cm, and the Ta film can be used for the gate electrode, but the resistivity of a $\beta$ phase Ta film is on the order of 180 $\mu\Omega$cm and the Ta film is unsuitable for the gate electrode. The $\alpha$ phase Ta film can easily be obtained if a tantalum nitride film, which possesses a crystal structure near that of $\alpha$ phase Ta, is formed with a thickness of 10 to 50 nm as a base for Ta in order to form the $\alpha$ phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 $\mu\Omega$cm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 $\mu\Omega$cm can be achieved.

Note that although the first conductive film 5008 and the second conductive film 5009 are formed from Ta and W, respectively, in Embodiment 4, the conductive films are not limited to these. Both the first conductive film 5008 and the second conductive film 5009 may also be formed from an element selected from the group consisting of Ta, W, Ti, Mo, Al, and Cu, or from an alloy material or a chemical compound material having one of these elements as its main constituent. Further, a semiconductor film, typically a polysilicon film, into which an impurity element such as phosphorous is doped, may also be used. Examples of preferable combinations other than that in Embodiment 4 include: the first conductive film 5008 formed from tantalum nitride (TaN) and the second conductive film 5009 formed from W; the first conductive film 5008 formed from tantalum nitride (TaN) and the second conductive film 5009 formed from Al; and the first conductive film 5008 formed from tantalum nitride (TaN) and the second conductive film 5009 formed from Cu.

Next, a mask 5010 is formed from resist, and a first etching process is performed in order to form electrodes and wirings. An ICP (inductively coupled plasma) etching method is used in Embodiment 4. A gas mixture of $CF_4$ and $Cl_2$ is used as an etching gas, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon nitride oxide film with respect to a W film is from 2 to 4 (typically 3), and therefore approximately 20 to 50 nm of the exposed surface of the silicon nitride oxide film is etched by this over-etching process. First shape conductive layers 5011 to 5016 (first conductive layers 5011*a* to 5016*a* and second conductive layers 5011*b* to 5016*b*) are thus formed of the first conductive layer and the second conductive layer by the first etching process. At this point, regions of the gate insulating film 5007 not covered by the first shape conductive layers 5011 to 5016 are made thinner by approximately 20 to 50 nm by etching. (FIG. 10A)

Then, a first doping process is performed to add an impurity element for imparting a n-type conductivity. Doping may be carried out by an ion doping method or an ion injecting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5011 to 5016 become masks to the impurity element to impart the n-type conductivity, and first impurity regions 5017 to 5020 are formed in a self-aligning manner. The impurity element to impart the n-type conductivity in the concentration range of $1\times10^{20}$ to $1\times10^{21}$ atoms/cm$^3$ is added to the first impurity regions 5017 to 5020. (FIG. 10B)

Next, as shown in FIG. 10C, a second etching process is performed without removing the resist mask. The etching gas of the mixture of $CF_4$, $Cl_2$ and $O_2$ is used, and the W film is selectively etched. At this point, second shape conductive layers 5021 to 5026 (first conductive layers 5021*a* to 5026*a* and second conductive layers 5021*b* to 5026*b*) are formed by the second etching process. Regions of the gate insulating film 5007, which are not covered with the second shape conductive layers 5021 to 5026 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and TaCl have almost equal vapor pressures. Thus, in the mixture gas of $CF_4$ and $Cl_2$, both the W film and the Ta film are etched. However. when a suitable amount of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Figures 11A, 11B, 11C:
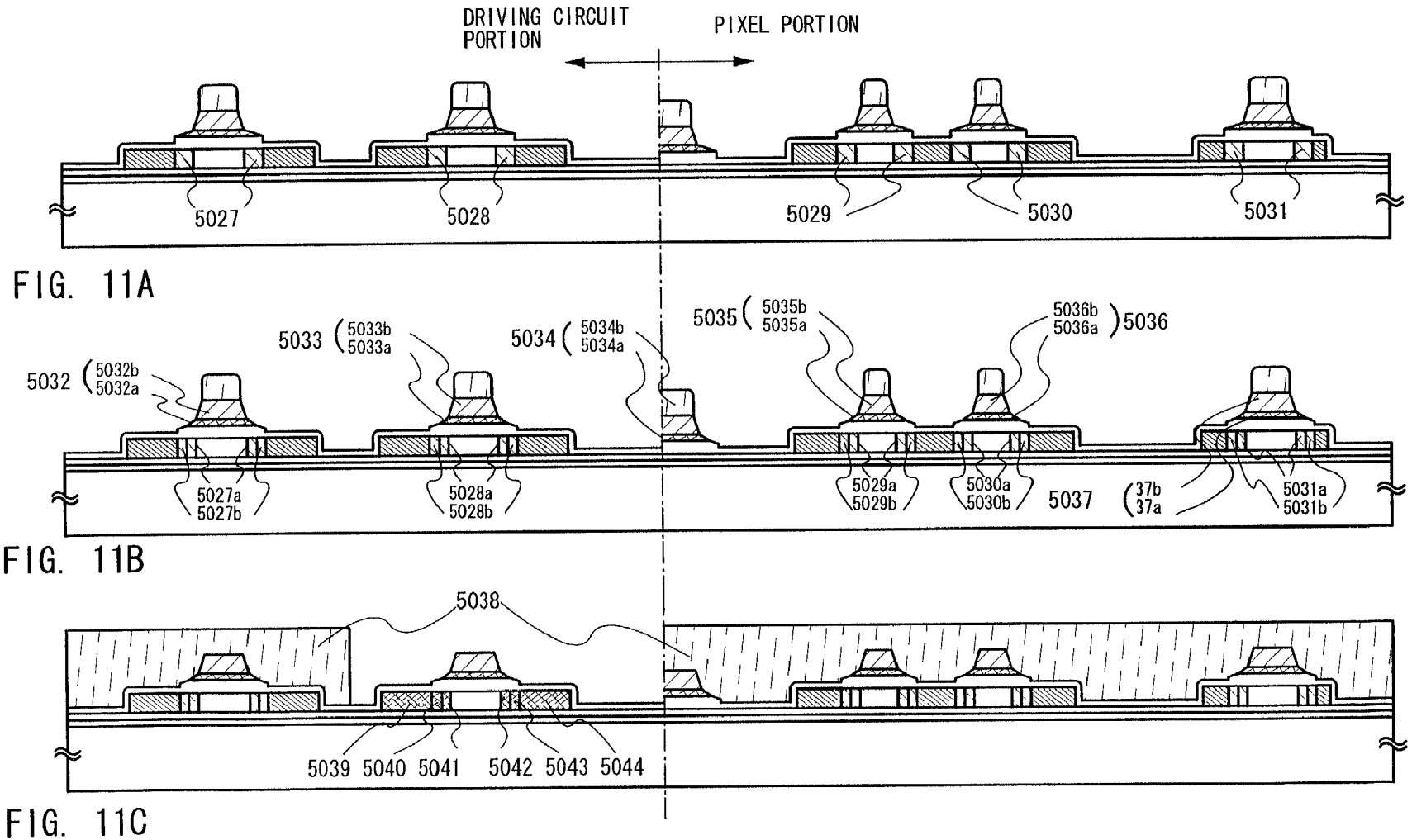
FIGS. 11A to 11C are diagrams showing examples of manufacturing steps of a liquid crystal display device with pixels of the present invention.

Then, as shown in FIG. 11A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 10B. Doping is carried out such that the second shape conductive layers 5021 to 5026 are used as masks to the impurity element and the impurity element is added also to the regions under the first conductive layers 5021*a* to 5026*a*. In this way, second impurity regions 5027 to 5031 are formed. The concentration of phosphorous (P) added to the second impurity regions 5027 to 5031 has a gentle concentration gradient in accordance with the thickness of tapered portions of the first conductive layers 5021*a* to 5026*a*. Note that in the semiconductor layer that overlap with the tapered portions of the first conductive layers 5021*a* to 5026*a*, the concentration of impurity element slightly falls from the end portions of the tapered portions of the first conductive layers 5021*a* to 5026*a* toward the inner portions, but the concentration keeps almost the same level.

As shown in FIG. 11B, a third etching process is performed. This is performed by using a reactive ion etching method (RIE method) with an etching gas of $CHF_6$. The tapered portions of the first conductive layers 5021*a* to

5026*a* are partially etched, and the region in which the first conductive layers overlap with the semiconductor layer is reduced by the third etching process. Third shape conductive layers 5032 to 5037 (first conductive layers 5032*a* to 5037*a* and second conductive layers 5032*b* to 5037*b*) are formed. At this point, regions of the gate insulating film 5007, which are not covered with the third shape conductive layers 5032 to 5037 are made thinner by about 20 to 50 nm by etching.

By the third etching process, in the case of second impurity regions 5027 to 5031, second impurity regions 5027*a* to 5031*a* which overlap with the first conductive layers 5032*a* to 5037*a*, and third impurity regions 5027*b* to 5231*b* between the first impurity regions and the second impurity regions.

Then, as shown in FIG. 11C, fourth impurity regions 5039 to 5044 having a conductivity type opposite to the first conductivity type are formed in the island-like semiconductor layers 5004 forming p-channel TFTs. The third conductive layers 5033*b* are used as masks to an impurity element, and the impurity regions are formed in a self-aligning manner. At this time, the whole surfaces of the island-like semiconductor layers 5003, 5005, the retention capacitor portion 5006 and the wiring portion 5034, which form n-channel TFTs are covered with a resist mask 5038. Phosphorus is added to the impurity regions 5039 to 5044 at different concentrations, respectively. The regions are formed by an ion doping method using diborane ($B_2H_6$) and the impurity concentration is made $2\times10^{20}$ to $2\times10^{21}$ atoms/$cm^3$ in any of the regions.

By the steps up to this, the impurity regions are formed in the respective island-like semiconductor layers. The third shape conductive layers 5032, 5033, 5035, and 5036 overlapping with the island-like semiconductor layers function as gate electrodes. The numeral 5034 functions as an island-like source signal line. The numeral 5037 functions as a capacitor wiring.

After the resist mask 5038 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 4, a heat treatment is conducted at 500° C. for 4 hours. However, in the case where a wiring material used for the third conductive layers 5037 to 5042 is weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Next, a first interlayer insulating film 5045 of a silicon oxynitride film is formed with a thickness of 100 to 200 nm. Then, a second interlayer insulating film 5046 of an organic insulating material is formed thereon. After that, etching is carried out to form contact holes.

Figure 12A:
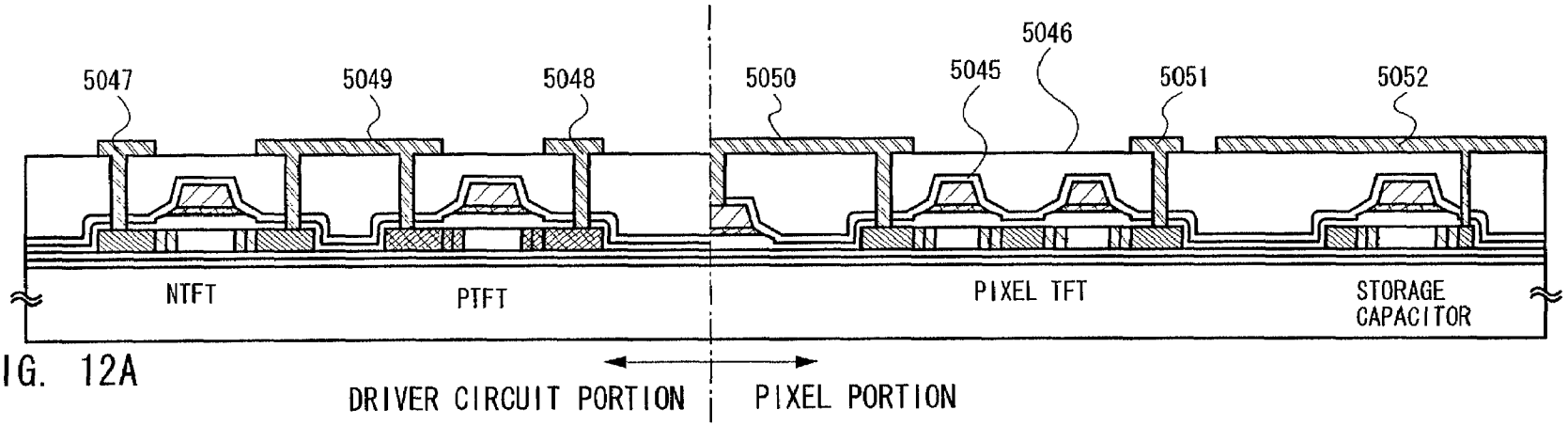
FIGS. 12A and 12B are diagrams showing examples of manufacturing steps of a liquid crystal display device with pixels of the present invention.

Then, in the driver circuit portion, source wirings 5047 and 5048 for contacting the source regions of the island-like semiconductor layers, and a drain wiring 5049 for contacting the drain regions of the island-like semiconductor layers are formed. In the pixel portion, a connecting electrode 5050 and pixel electrodes 5051 and 5052 are formed (FIG. 12A). The connecting electrode 5050 allows electric connection between the source signal line 5034 and pixel TFTs. It is to be noted that the pixel electrode 5052 and a storage capacitor are of an adjacent pixel.

As described above, the driver circuit portion having the n-type TFT and the p-type TFT and the pixel portion having the pixel TFT and the storage capacitor can be formed on one substrate. Such a substrate is herein referred to as an active matrix substrate.

In this embodiment, end portions of the pixel electrodes are arranged so as to overlap signal lines and scanning lines for the purpose of shielding from light spaces between the pixel electrodes without using a black matrix.

Further, according to the process described in the present embodiment, the number of photomasks necessary for manufacturing an active matrix substrate can be set to five (a pattern for the island-like semiconductor layers, a pattern for the first wirings (scanning lines, signal lines, and capacitor wirings), a mask pattern for the p channel regions, a pattern for the contact holes, and a pattern for the second wirings (including the pixel electrodes and the connecting electrodes)). As a result, the process can be made shorter, the manufacturing cost can be lowered, and the yield can be improved.

Figure 12B:
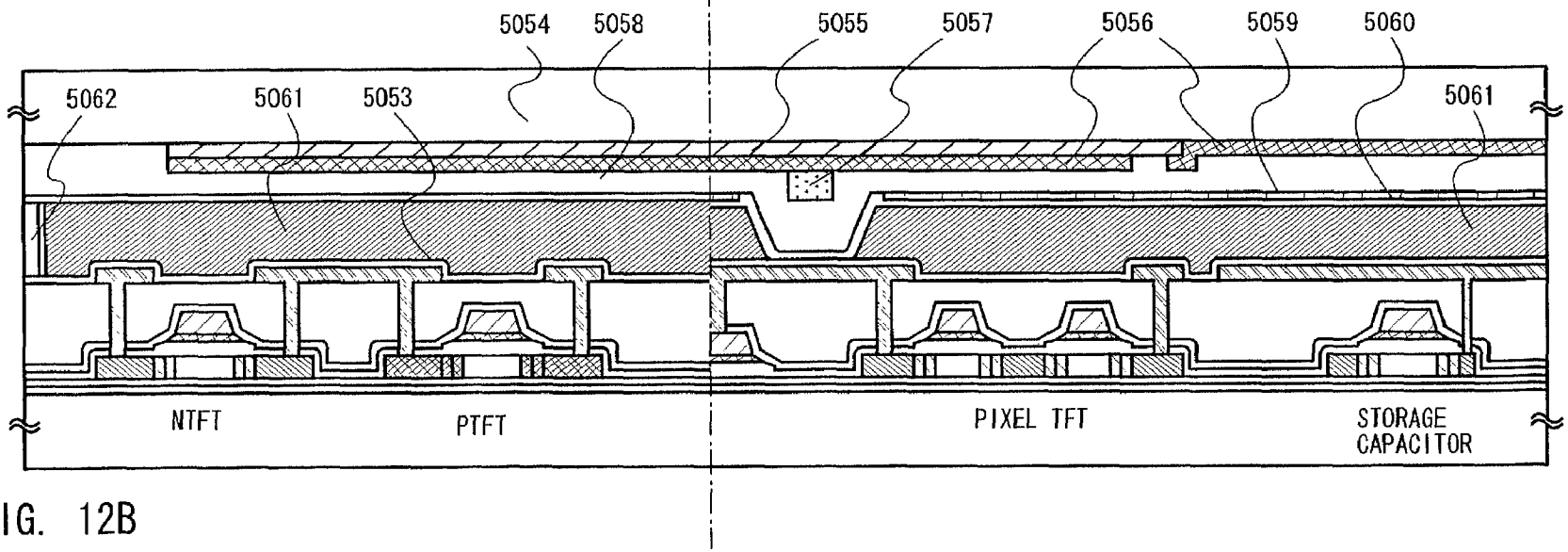
Figure 13:
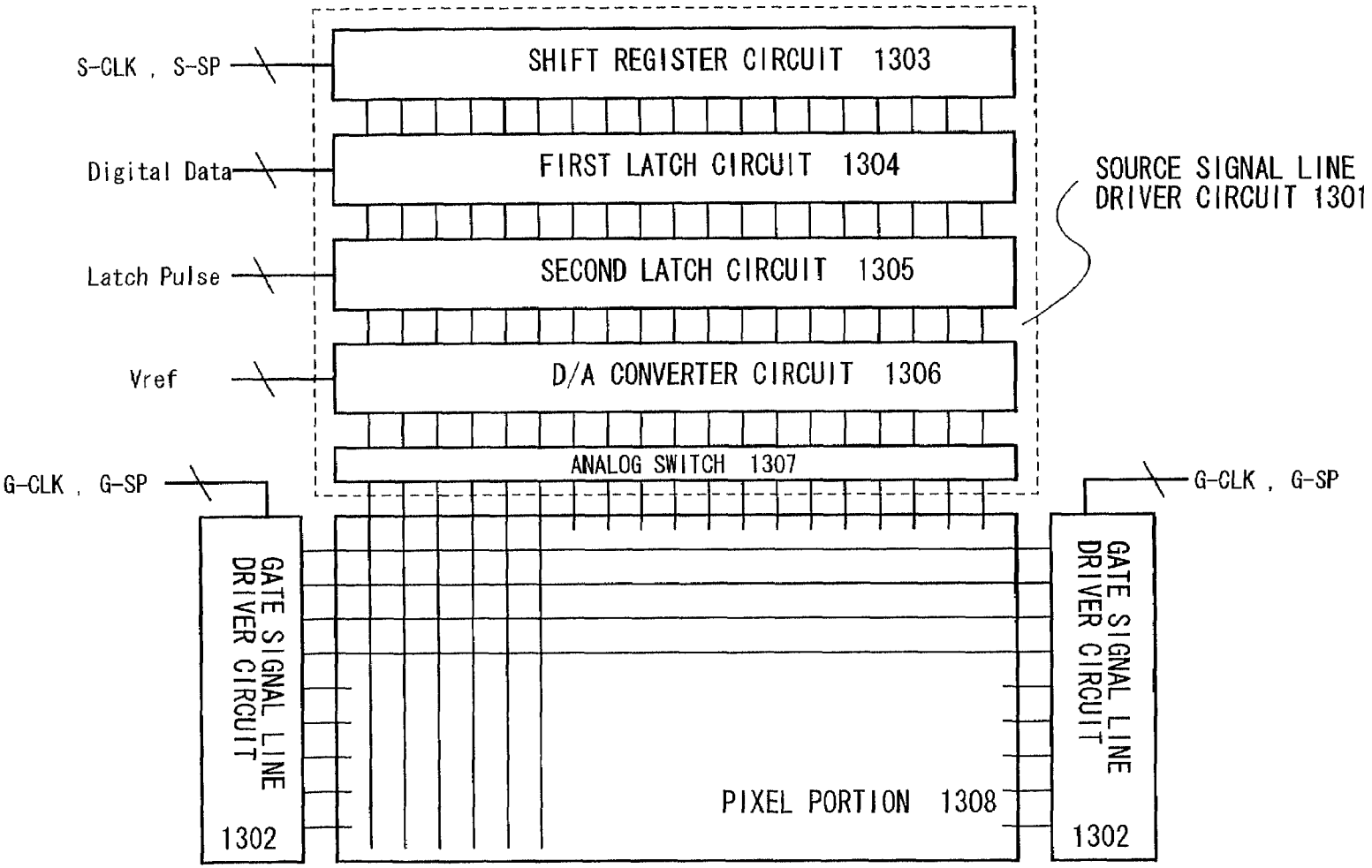
FIG. 13 is a diagram simply showing an entire circuit structure of a conventional liquid crystal display device.
Figure 14:
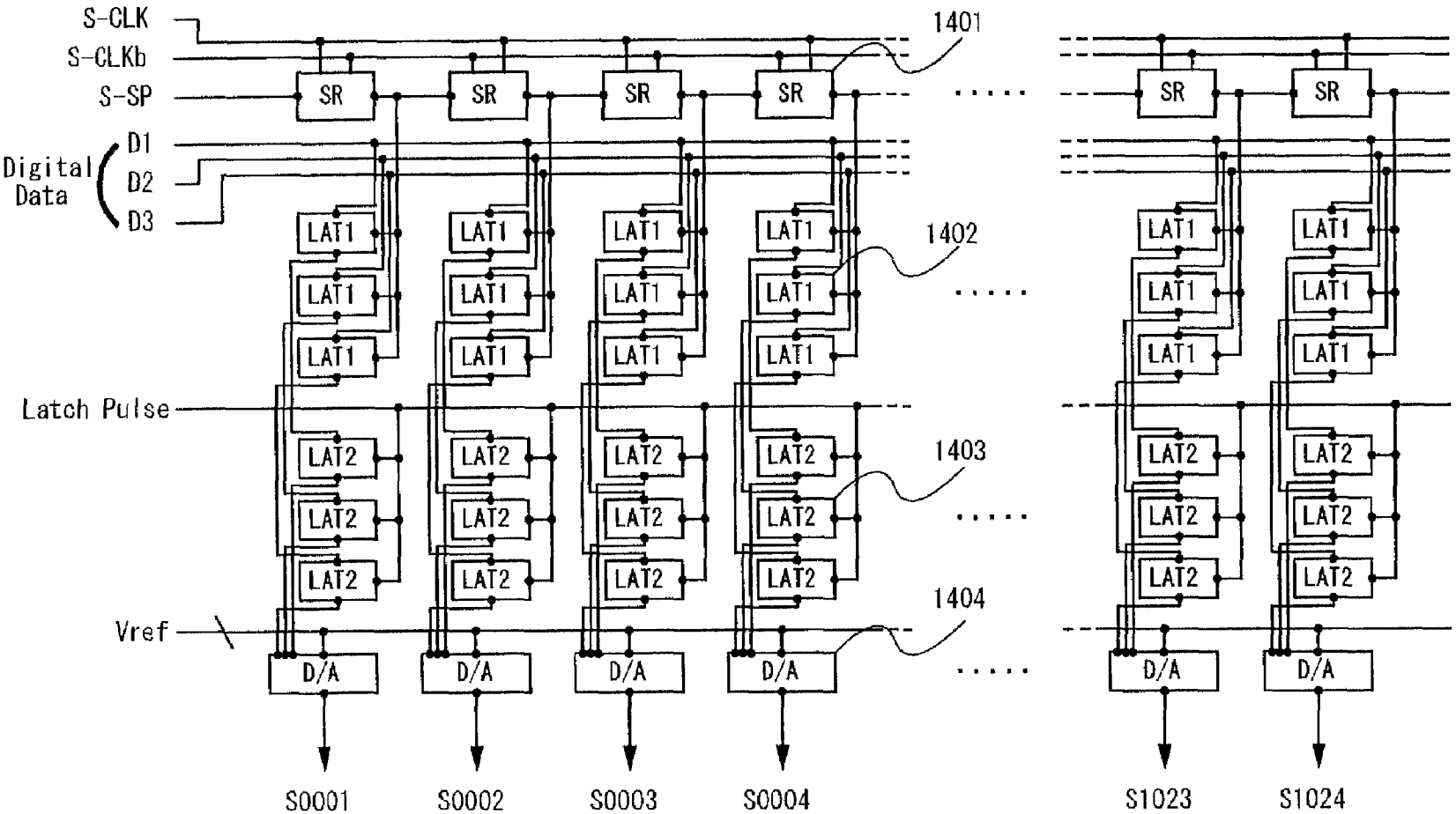
FIG. 14 is a diagram showing a circuit structure example of a source signal line driver circuit of a conventional liquid crystal display device.

Next, after the active matrix substrate as illustrated in FIG. 12B is obtained, an orientation film 5053 is formed on the active matrix substrate and a rubbing treatment is carried out.

Meanwhile, an opposing substrate 5054 is prepared. Color filter layers 5055 to 5057 and an overcoat layer 5058 are formed on the opposing substrate 5054. The color filter layers are structured such that the red color filter layer 5055 and the blue color filter layer 5056 overlap over the TFTs so as to serve also as a light-shielding film. Since it is necessary to shield from light at least spaces among the TFTs, the connecting electrodes, and the pixel electrodes, it is preferable that the red color filter and the blue color filter are arranged so as to overlap such that these places are shielded from light.

The red color filter layer 5055, the blue color filter layer 5056, and the green color filter layer 5057 are overlapped so as to align with the connecting electrode 5050 to form a spacer. The respective color filters are formed by mixing appropriate pigments in an acrylic resin and are formed with a thickness of 1 to 3 $\mu$m. These color filters can be formed from a photosensitive material in a predetermined pattern using a mask. Taking into consideration the thickness of the overcoat layer 5058 of 1 to 4 $\mu$m, the height of the spacer can be made to be 2 to 7 $\mu$m, preferably 4 to 6 $\mu$m. This height forms a gap when the active matrix substrate and the opposing substrate are adhered to each other. The overcoat layer 5058 is formed of a photosetting or thermosetting organic resin material such as a polyimide resin or an acrylic resin.

The arrangement of the spacer may be arbitrarily determined. For example, as illustrated in FIG. 12B, the spacer may be arranged on the opposing substrate 5054 so as to align with the connecting electrode 5050. Or, the spacer may be arranged on the opposing substrate 5054 so as to align with a TFT of the driver circuit portion. Such spacers may be arranged over the whole surface of the driver circuit portion, or may be arranged so as to cover the source wirings and the drain wirings.

After the overcoat layer 5058 is formed, an opposing electrode 5059 is patterned to be formed, an orientation film 5060 is formed, and a rubbing treatment is carried out.

Then, the active matrix substrate having the pixel portion and the driver circuit portion formed thereon is adhered to the opposing substrate using a sealant 5062. Filler is mixed in the sealant 5062. The filler and the spacers help the two substrates to be adhered to each other with a constant gap therebetween. After that, a liquid crystal material 5061 is injected between the substrates, and encapsulant (not shown) carries out full encapsulation. As the liquid crystal material 5061, a known liquid crystal material may be used. In this way, an active matrix liquid crystal display device as illustrated in FIG. 12B is completed.

It is to be noted that, though the TFTs in the active matrix type display device formed in the above processes are of a top-gate structure, this embodiment may be easily applied to TFTs of a bottom-gate structure and of other structures.

Further, the glass substrate is used in this embodiment, but it is not limited. Other than glass substrate, such as the plastic substrate, the stainless substrate and the single crystalline wafers can be used to implement.

[Embodiment 5]

A display device of the present invention uses a time gray scale method as a means of expressing gray scale. Therefore, in the case of using a liquid crystal element in a pixel, a faster response speed is required when compared with a normal analog gray scale. Thus, it is preferable to use a ferroelectric liquid crystal (FLC). In this embodiment, in a manufacturing step of the display device introduced in Embodiment 4, an example of manufacturing a substrate in the case of using ferroelectric liquid crystals for liquid crystal elements is described. FIG. 9 will be referred to in the explanation.

Figures 9A, 9B:
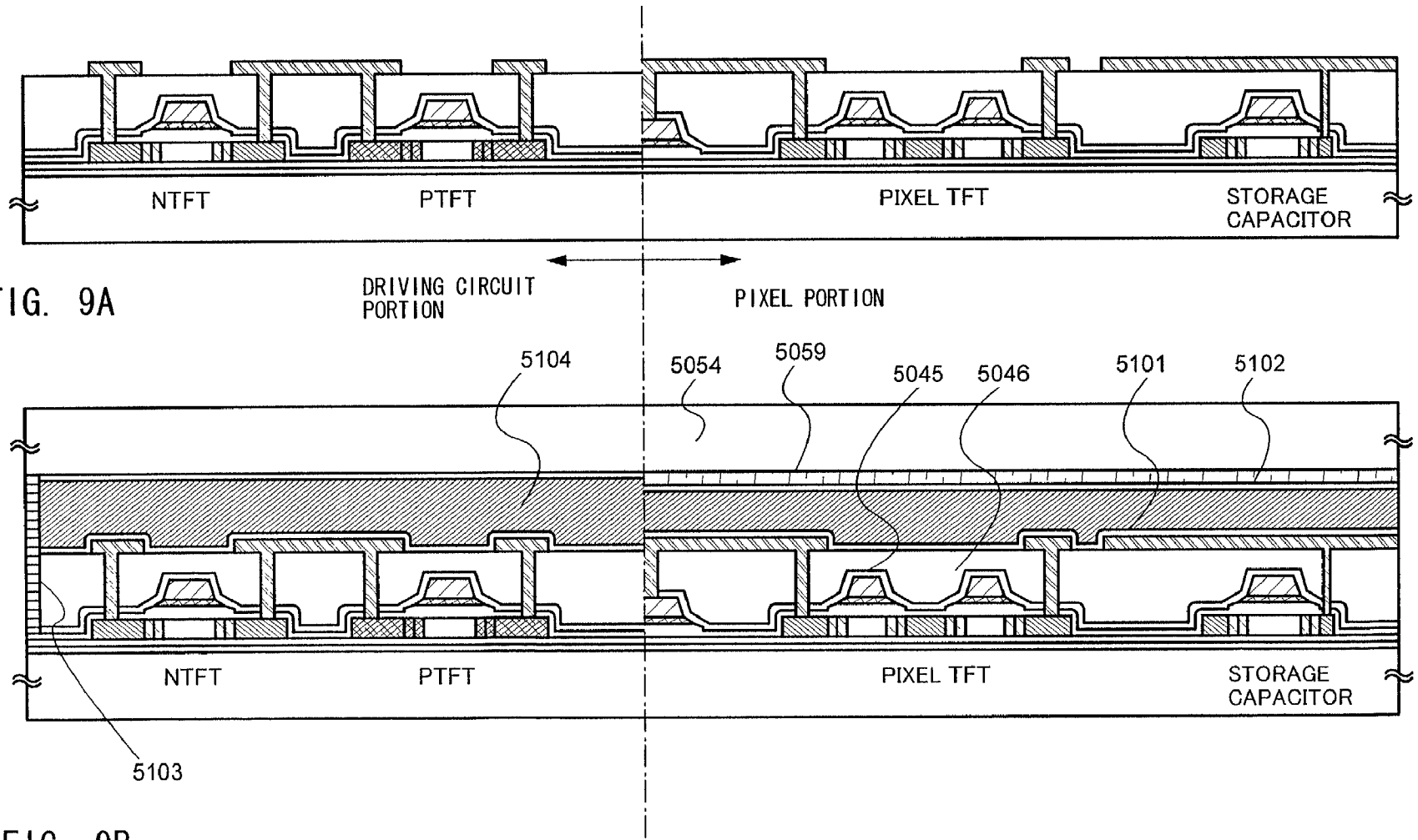
FIGS. 9A and 9B are diagrams showing examples of manufacturing steps of a liquid crystal display device with the pixels in the present invention.

In accordance with Embodiment 4, an active matrix substrate shown in FIG. 9A (similar to FIG. 12A) and an opposing substrate 5054 are manufactured.

Orientation films 5101 and 5102 are formed on the active matrix substrate and the opposing substrate. An orientation film RN 1286 of Nissan Chemical Industries, Ltd. is formed and prebaked for 5 minutes at 90° C. Thereafter, it is postbaked for one hour at 250° C. The film thickness after postbaking is 40 nm. The formation method of the orientation film may be conducted by a flexographic printing method or a spinner application method. The RN 1286 has unsatisfactory adhesiveness with a seal agent, thus the orientation film is removed at the position where the seal agent is placed. Further, the orientation film is not formed above a lead wire which connects the orientation film on the contact pad electrically connecting the active matrix substrate and the opposing substrate, and the flexible printed circuit (FPC).

Rubbing is performed on orientation films 5101 and 5102. Here, the direction of the rubbing when the opposing substrate 5054 and the active matrix substrate are adhered together is made parallel. In the rubbing process, as a rubbing cloth, YA-20R of Yoshikawa Chemicals is used. The rubbing is performed by the rubbing device of Joyo Engineering Co., Ltd. with a pressing amount of 0.25 mm, the roll rotation number of 100 rpm, the stage speed of 10 mm/sec. and the rubbing number as once. The diameter of the rubbing roll is 130 mm. The orientation film is washed by radiating water to the substrate surface after rubbing.

Next, a seal agent 5103 is formed. The seal agent is provided with an inlet of the liquid crystal material in one part, and may be a pattern where injection may be performed in a vacuum state.

The seal agent was formed on the opposing substrate by a seal dispenser of Hitachi Chemical Co., Ltd. The seal agent used is an XN-21S of Mitsui Chemicals. The pre-baking of the seal agent was performed for 30 minutes at 90° C., and slowly cooled in the next 15 minutes.

It is known that even if the seal agent XN-21S is heat-pressed, only a cell gap of 2.3 to 2.6 $\mu$m may be obtained. In order to form a cell gap of 1.0 $\mu$m, the seal agent should be arranged by providing a region with a thin thickness of a lamination film of 1.5 $\mu$m or more compared to the pixel portion. In this embodiment, the seal agent 5103 is arranged in the region where a first interlayer insulating film 5045 and a second interlayer insulating film 5046 are removed by etching.

The conductive spacer is formed simultaneously with the time when the seal agent is formed.

The spacer (not shown) is formed on the opposing substrate or the active matrix substrate. As the spacer, spherical beads may be scattered. On the other hand, a photosensitive resin may be patterned as a dot shape or a stripe shape in the display region. An orientation fault of liquid crystal material may be prevented by the spacers.

The cell gap of the reflection type liquid crystal display device is preferably 0.5 to 1.5 $\mu$m considering retardation. In this embodiment, the cell gap in the pixel portion is made to be 1.0 $\mu$m.

Thereafter, by a pasting device of Newton Limited, the opposing substrate and the active matrix substrate markers are matched together, to perform pasting together.

Next, a pressure of 0.3 to 1.0 kgf/cm$^2$ is applied in a vertical direction to the substrate plane and to the entire surface of the substrate, heat curing is performed for 3 hours in a clean oven at 160° C., the seal agent is cured, and the opposing substrate and the active matrix substrate are adhered.

A pair of substrates formed by pasting together the opposing substrate and the active matrix substrate is parted.

A liquid crystal material 5104 uses a ferroelectric liquid crystal showing bistableness, antiferroelectric liquid crystal showing tristableness and the like.

The liquid crystal material is heated until it becomes isotropic and then injected. Thereafter, it is slowly cooled to 0.1° C./min to room temperature.

As a sealing agent an ultraviolet curing type resin (not shown) may be applied by a compact dispenser covering the inlet.

Thereafter, a flexible printed wiring board (not shown) is adhered by an anisotropic conductive film (not shown), and the active matrix liquid crystal display device is complete.

With a pixel electrode of the active matrix substrate as a transparent conductive film, a transparent type liquid crystal display device may also be manufactured with the steps of this embodiment. The cell gap of the transparent type liquid crystal display device is preferably 1.0 to 2.5 $\mu$m in view of retardation and to suppress the spiral structure of the ferroelectric liquid crystal.

[Embodiment 6]

The liquid crystal display device of the present invention has a plurality of storage circuits in the pixel portion, so that the number of elements structuring one pixel is more than in normal pixels. Therefore, in the case of the transparent type liquid crystal display device, since brightness deficiency due to decreasing of the aperture ratio is possible, the present invention is preferably applied to the reflection type liquid crystal display device. In this embodiment, one example of the manufacturing steps is shown.

Figure 19A:
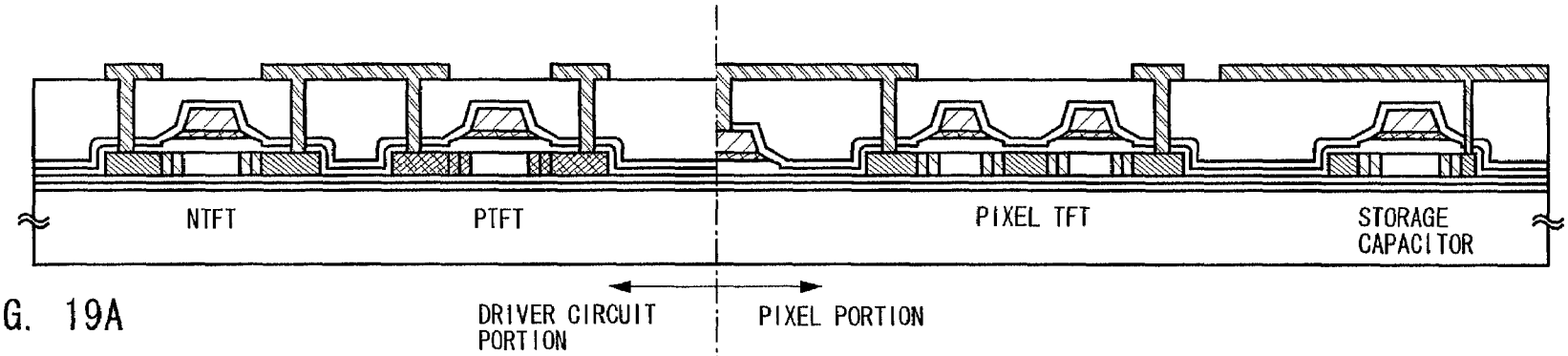
FIGS. 19A and 19B are diagrams showing examples of manufacturing steps of a reflection type liquid crystal display device.

In accordance with Embodiment 4, the active matrix substrate shown in FIG. 19A (similar to FIG. 12A) is formed. Subsequently, after a resin film is formed as a third interlayer insulating film 5201, a contact hole is opened in the pixel electrode portion and a reflecting electrode 5202 is formed. As a reflecting electrode 5202, a material with superior reflectivity, such as a film with main constituents of Al and Ag, or a lamination film of those is preferably used.

Meanwhile, an opposing substrate 5054 is prepared. The opposing substrate 5054 is formed by patterning an opposing substrate 5205 in this embodiment. The opposing substrate 5205 is formed as a transparent conductive film. As a transparent conductive film, a material formed of a compound of indium oxide and tin oxide (referred to as ITO) or a compound of indium oxide and zinc oxide may be used.

Although not particularly shown, when forming a color liquid crystal display device, color filter layers are formed. At this time, the structure may be such that adjacent color filter layers with different colors are formed overlapping each other, and is also a light shielding film of the TFT portion.

Thereafter, orientation films 5203 and 5204 are formed on the active matrix substrate and the opposing substrate, and a rubbing process is performed.

Figure 19B:
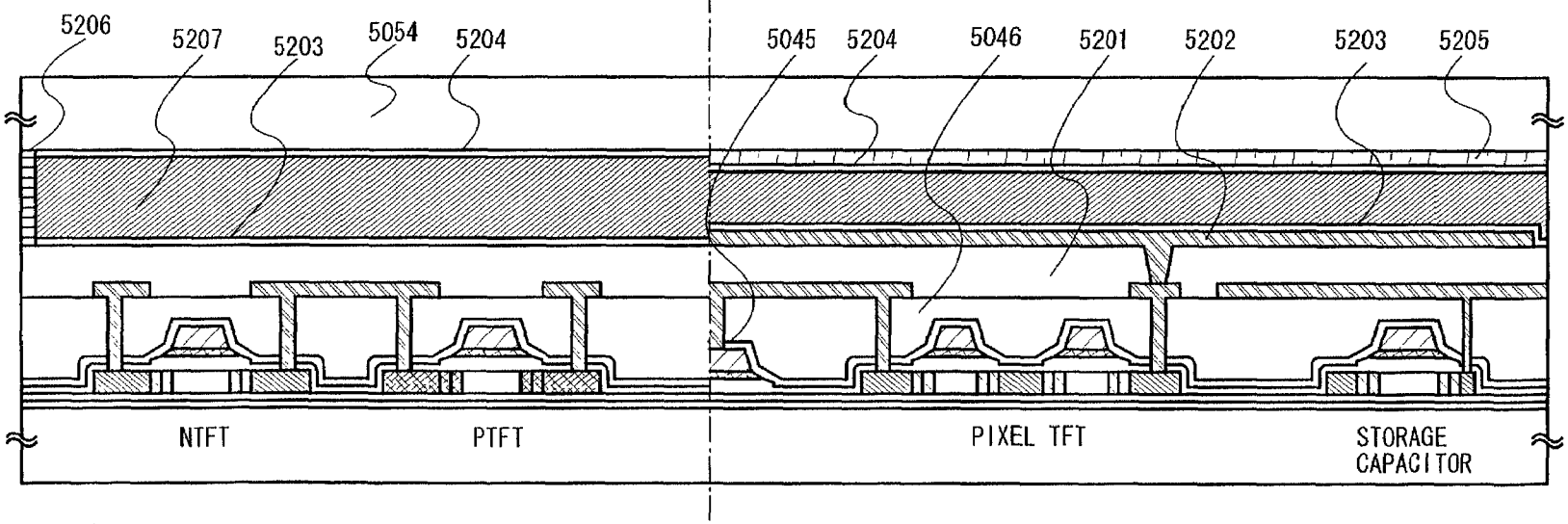

Then, the active matrix substrate formed with the pixel portion and the driver circuit portion, and the opposing substrate are pasted together with a seal agent 5206. The seal agent 5206 is mixed with a filler, and the two substrates are pasted together with a uniform interval by this filler and the spacer. Then, a liquid crystal material 5207 is injected in between both substrates, and completely sealed by the sealing agent (not shown). As a liquid crystal material 5207 a known liquid crystal material may be used. In this way, the reflection type liquid crystal display device shown in FIG. 19B is completed.

Note that, in this embodiment, it is possible to use, apart from a glass substrate, a plastic substrate, a stainless substrate, a monocrystalline wafer and the like.

Further, the present invention may be easily applied to a case where a semitransparent type display device is formed with half the pixel as a reflecting electrode and the remaining half as a transparent electrode.

[Embodiment 7]

In the pixel portion of the liquid crystal display device of the present invention shown in Embodiments 1 to 3, it is formed by using as the storage circuit a static memory (Static RAM: SRAM), but the storage circuit is not limited to SRAM only. As a storage circuit which is applicable to the pixel portion of the liquid crystal display device of the present invention, there are such as a dynamic memory (dynamic RAM: DRAM). In this embodiment, an example of structuring a circuit using these storage circuits is introduced.

Figure 8:
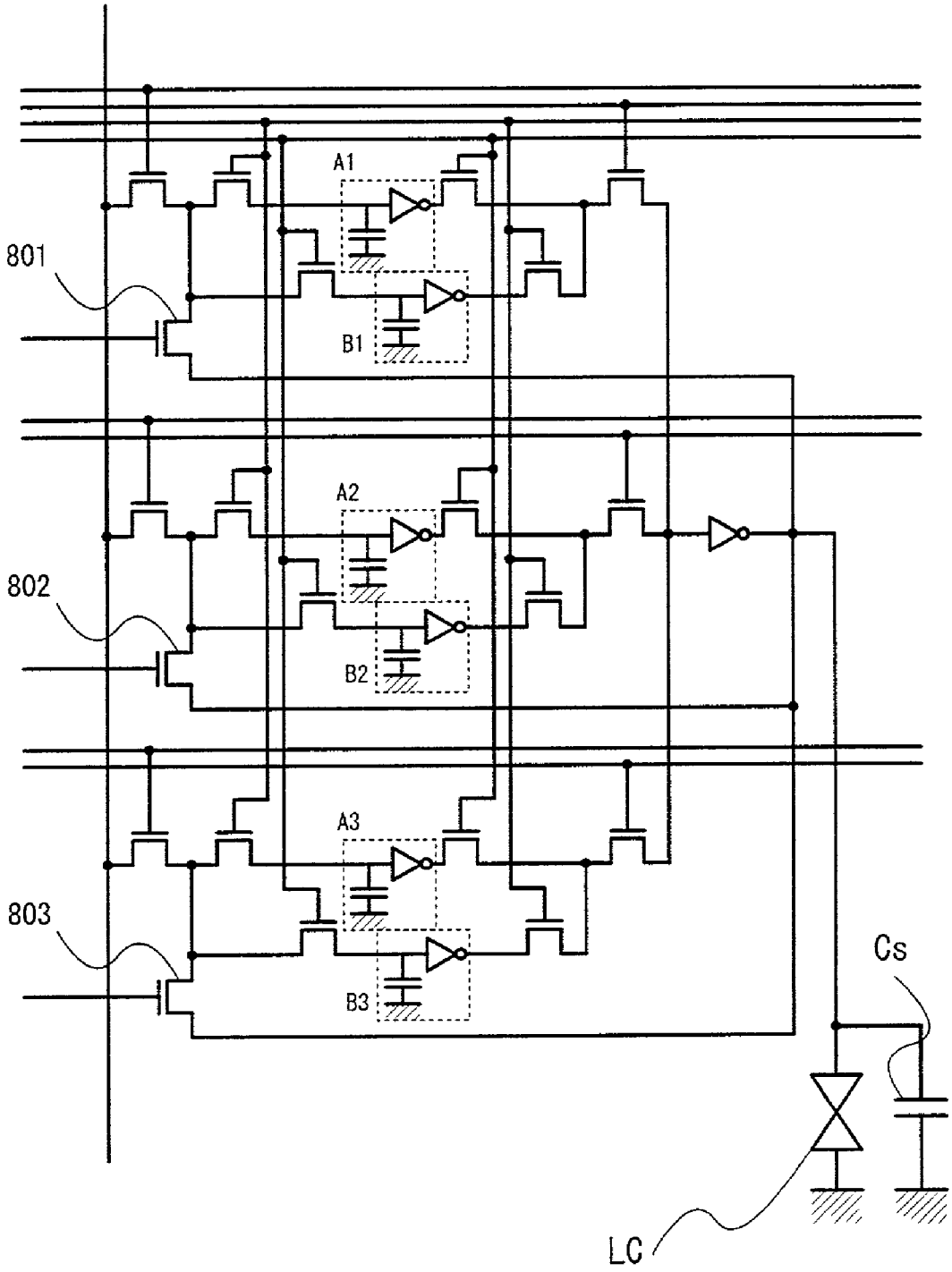
FIG. 8 is a detailed circuit diagram of a pixel of the present invention when a dynamic memory is used in the storage circuit.

FIG. 8 shows an example of using DRAM in the storage circuits A1 to A3 and B1 to B3 which are arranged in the pixel. The basic structure is similar to the circuit shown in Embodiment 1. DRAM used in the storage circuits A1 to A3 and B1 to B3 may use that with a general structure. In this embodiment, DRAM with a simple structure and structured by an inverter and a capacitor may be used, and shown in the figure.

The operation of the source signal line driver circuit is the same as Embodiment 1. Here, different to SRAM, in the case of DRAM, since a rewrite in to the storage circuit every certain period (hereinafter this operation is referred to as refresh) is required, refresh TFTs 801 to 803 are provided. Refresh is carried out at a certain timing in a period where a still image is displayed (a period performing display by repeatedly reading the digital image signal stored in the storage circuit), by making each of the refresh TFTs 801 to 803 in continuity, and by making a charge in the pixel portion feedback to the storage circuit side.

Further, although not particularly shown, as other forms of storage circuits, the pixel portion of the liquid crystal display device of the present invention may be structured by using ferroelectric memory (ferroelectric RAM: FeRAM). FeRAM is a nonvolatile memory having the same writing speed as SRAM and DRAM, and lower power consumption of the liquid crystal display device of the present invention is possible by making use of the characteristic that the write in voltage is low or the like. Further, structuring is possible by using such as flash memory.

[Embodiment 8]

An active matrix type display device using a driver circuit which is formed along with the present invention have various usage. In this embodiment, the semiconductor device implemented the display device using a driver circuit which is formed along with the present invention.

The following can be given as examples of such display device: a portable information terminal (such as an electronic book, a mobile computer, or a cell phone), a video camera; a digital camera; a personal computer and a television. Examples of those electronic equipments are shown in FIGS. 15 and 16.

Figure 15A:
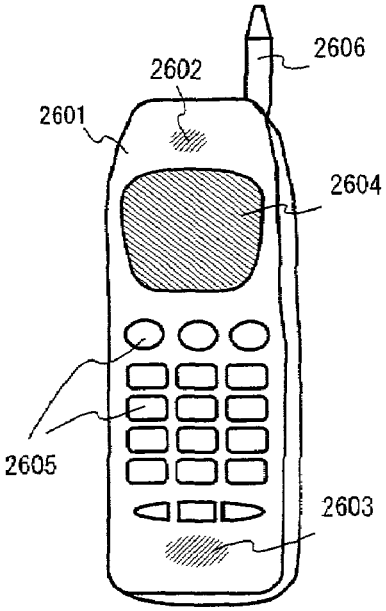
FIGS. 15A to 15F are diagrams showing examples of electric equipment applicable to a display device with a pixel of the present invention.

FIG. 15A is a cell phone which includes a main body 2601, a voice outputted portion 2602, a voice inputted portion 2603, a display portion 2604, operation switches 2605, and an antenna 2606. The present invention can be applied to the display portion 2604.

Figure 15B:
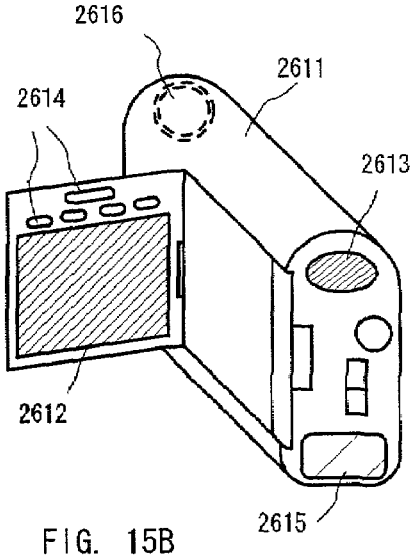

FIG. 15B illustrates a video camera which includes a main body 2611, a display portion 2612, an audio inputted portion 2613, operation switches 2614, a battery 2615, an image receiving portion 2616, or the like. The present invention can be applied to the display portion 2612.

Figure 15C:
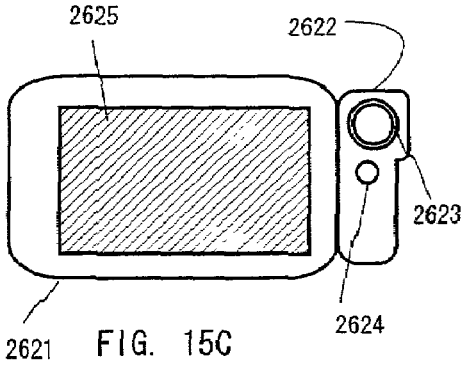

FIG. 15C illustrates a mobile computer or portable information terminal which includes a main body 2621, a camera section 2622, an image receiving section 2623, operation switches 2624, a display portion 2625, or the like. The present invention can be applied to the display portion 2625.

Figure 15D:
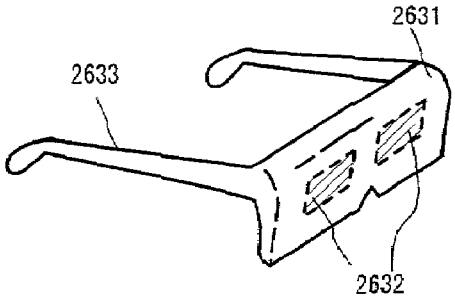

FIG. 15D illustrates a head mounted display which includes a main body 2631, a display portion 2632 and an arm portion 2633. The present invention can be applied to the display portion 2632.

Figure 15E:
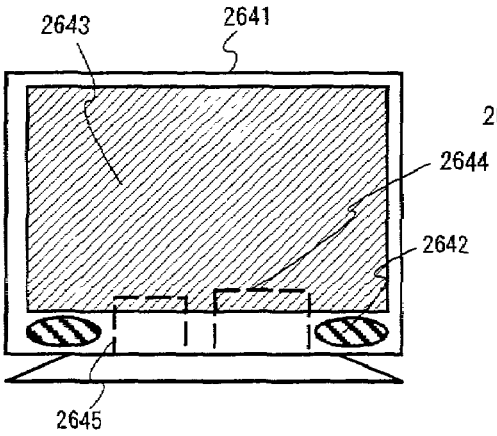

FIG. 15E illustrates a television which includes a main body 2641, a speaker 2642, a display portion 2643, a receiving device 2644 and an amplifier device 2645. The present invention can be applied to the display portion 2643.

Figure 15F:
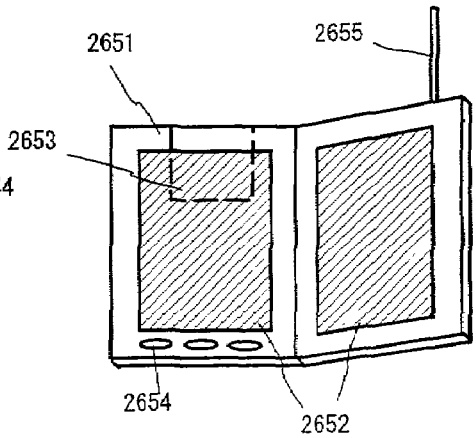

FIG. 15F illustrates a portable electronic book which includes a main body 2651, display portion 2652, a memory medium 2653, an operation switch 2654 and an antenna 2655 and the portable electronic displays a data recorded in mini disc (MD) and DVD (Digital Versatile Disc) and a data recorded by an antenna. The present invention can be applied to the display portions 2652.

Figure 16A:
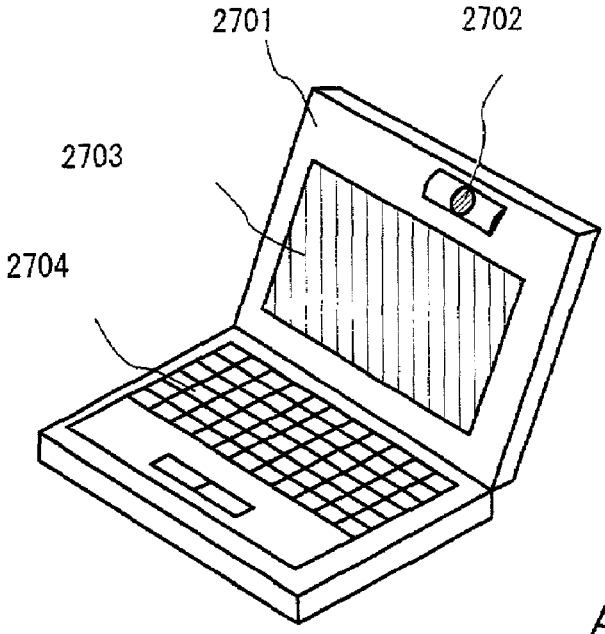
FIGS. 16A to 16D are diagrams showing examples of electric equipment applicable to a display device with a pixel of the present invention.

FIG. 16A illustrates a personal computer which includes a main body 2701, an image inputted portion 2702, a display portion 2703, a key board 2704, or the like. The present invention can be applied to the display portion 2703.

Figure 16B:
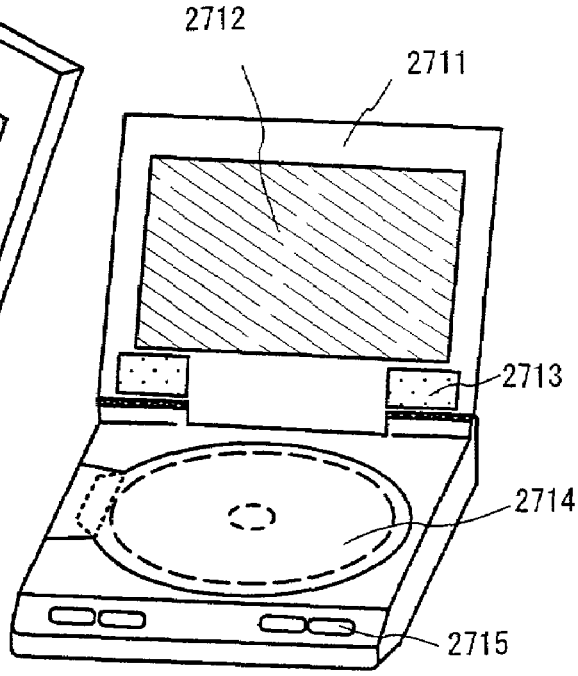

FIG. 16B illustrates a player using a recording medium which records a program (hereinafter referred to as a recording medium) and includes a main body 2711, a display portion 2712, a speaker section 2713, a recording medium 2714, and operation switches 2715. This player uses DVD (digital versatile disc), CD, etc. for the recording medium, and can be used for music appreciation, film appreciation, games and Internet. The present invention can be applied to the display portion 2712.

Figure 16C:
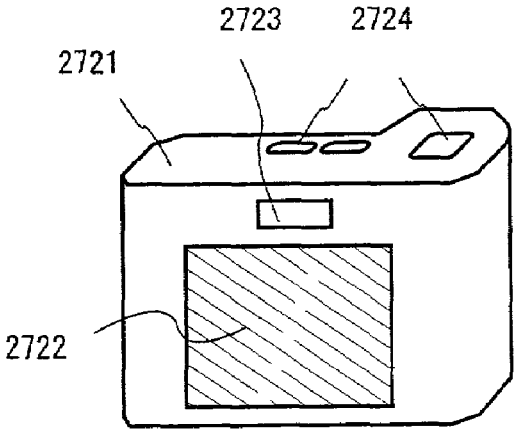

FIG. 16C illustrates a digital camera which includes a main body 2721, a display portion 2722, a view finder portion 2723, operation switches 2724, and an image receiving section (not shown in the figure). The present invention can be applied to the display portion 2722.

Figure 16D:
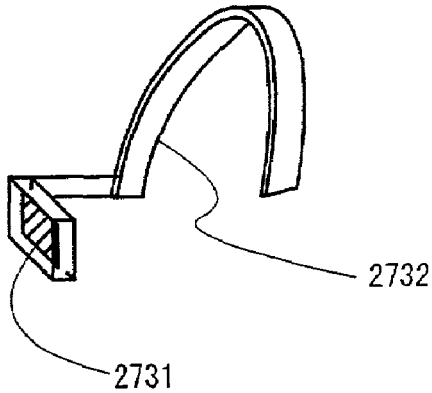

FIG. 16D illustrates a one-eyed head mounted display which includes a main body 2731 and band portion 2732. The present invention can be applied to the display portion 2731.

By storing the digital image signal using a plurality of storage circuits arranged inside each pixel, the digital image signal stored in the storage circuit in each frame period when displaying the still image is repeatedly used, and when performing a still image display continually, the source signal line driver circuit may be stopped. Thus, it greatly contributes to the low power consumption of the entire liquid crystal display device.

What is claimed is:

1. A liquid crystal display device having a plurality of pixels, wherein the plurality of pixels respectively comprise:

a plurality of storage circuits;

a write-in storage circuit selection portion electrically connected to a selected one of the plurality of storage circuits;

a read storage circuit selection portion electrically connected to a selected one of the plurality of storage circuits;

a write-in transistor electrically connected to the selected one of the plurality of storage circuits through the write-in storage circuit selection portion;

a read transistor electrically connected to the selected one of the plurality of storage circuits through the read storage circuit selection portion; and a liquid crystal element electrically connected to the read transistor.

2. A device according to claim 1, wherein the storage circuit is a static memory (SRAM).

3. A device according to claim 1, wherein the storage circuit is a ferroelectric memory (FeRAM).

4. A device according to claim 1, wherein the storage circuit is a dynamic memory (DRAM).

5. A device according to claim 1, wherein the storage circuit is formed on a glass substrate.

6. A device according to claim 1, wherein the storage circuit is formed on a plastic substrate.

7. A device according to claim 1, wherein the storage circuit is formed on a stainless substrate.

8. A device according to claim 1, wherein the storage circuit is formed on a monocrystalline wafer substrate.

9. An electronic device using a liquid crystal display device according to claim 1.

10. A method according to claim 9, wherein the electronic device is selected from the group consisting of a television, a personal computer, a portable terminal, a video camera or a head mount display.

11. A liquid crystal display device having a plurality of pixels, wherein the plurality of pixels respectively comprise:

n×m storage circuits for storing m frames (m is an integer, where $1 \leqq m$) of an n bit digital image signal (n is an integer, where $2 \leqq n$);

n write-in storage circuit selectors, each of the n write-in storage circuit selectors being electrically connected to one of the n×m storage circuits;

n read storage circuit selectors, each of the n read storage circuit selectors being electrically connected to one of the n×m storage circuits;

n write-in transistors, each of the n write-in transistors being electrically connected to a corresponding one of the n write-in storage circuit selectors;

n read transistors, each of the n read transistors being electrically connected to a corresponding one of the n read storage circuit selectors; and a liquid crystal element electrically connected to the n read transistors, wherein each of the n read transistors controls reading of m storage circuits, and wherein each of the n write-in transistors controls writing of m storage circuits.

12. A device according to claim 11, wherein the storage circuit is a static memory (SRAM).

13. A device according to claim 11, wherein the storage circuit is a ferroelectric memory (FeRAM).

14. A device according to claim 11, wherein the storage circuit is a dynamic memory (DRAM).

15. A device according to claim 11, wherein the storage circuit is formed on a glass substrate.

16. A device according to claim 11, wherein the storage circuit is formed on a plastic substrate.

17. A device according to claim 11, wherein the storage circuit is formed on a stainless substrate.

18. A device according to claim 11, wherein the storage circuit is formed on a monocrystalline wafer substrate.

19. An electronic device using a liquid crystal display device according to claim 11.

20. A method according to claim 19, wherein the electronic device is selected from the group consisting of a television, a personal computer, a portable terminal, a video camera or a head mount display.

21. A liquid crystal display device having a plurality of pixels, each of the plurality of pixels comprising:

a source signal line;

n write-in gate signal lines (n is an integer, where $2 \leqq n$);

n read gate signal lines;

n write-in transistors, gate electrodes of the n write-in transistors being respectively electrically connected to any one of the different n write-in gate signal lines;

n read transistors, gate electrodes of the n read transistors being respectively electrically connected to any one of the different n read gate signal lines;

n×m storage circuits for storing m frames (m is an integer, where $1 \leqq m$) of an n bit digital image signal;

n write-in storage circuit selection portions;

n read storage circuit selection portions having m signal output portions, respectively; and a liquid crystal element, wherein one of a source and a drain region of the n write-in transistor is electrically connected to a source signal line, and the other is electrically connected to any one of the different signal input portions of the n write-in storage circuit selection portions;

wherein and the m signal output portions respectively are electrically connected to signal input portions of the different m storage circuits;

wherein the m signal input portions respectively are electrically connected to the signal output portions of the different m storage circuits; and wherein one of the source region and the drain region of n read transistors is electrically connected to any one of the different signal output portions of the n read storage circuit selection portions, and the other is electrically connected to one electrode of the liquid crystal element.

22. A device according to claim 21, wherein the write-in storage circuit selection portion selects any one of m storage circuits, and becomes in continuity with one of a source region or a drain region of the write-in transistor to thereby write in the digital image signal to the storage circuit, and wherein the read storage circuit selection portion selects any one of the storage circuits storing the digital image signal, and becomes in continuity with one of a source region or a drain region of the read transistor to thereby read the digital image which is stored.

23. A device according to claim 21, further comprising:

a shift register which sequentially outputs a sampling pulse according to a clock signal and a start pulse;

a first latch circuit holding n bit digital image signals (n is an integer, where $2 \leqq n$) according to the sampling pulse;

a second latch circuit to which the n bit digital image signals held in the first latch circuit are transferred; and a bit signal selection switch which selects in order by each bit the n bit digital image signals transferred to the second latch circuit, and then outputs to the source signal line.

24. A device according to claim 21, wherein the storage circuit is a static memory (SRAM).

25. A device according to claim 21, wherein the storage circuit is a ferroelectric memory (FeRAM).

26. A device according to claim 21, wherein the storage circuit is a dynamic memory (DRAM).

27. A device according to claim 21, wherein the storage circuit is formed on a glass substrate.

28. A device according to claim 21, wherein the storage circuit is formed on a plastic substrate.

29. A device according to claim 21, wherein the storage circuit is formed on a stainless substrate.

30. A device according to claim 21, wherein the storage circuit is formed on a monocrystalline wafer substrate.

31. An electronic device using a liquid crystal display device according to claim 21.

32. A method according to claim 31, wherein the electronic device is selected from the group consisting of a television, a personal computer, a portable terminal, a video camera or a head mount display.

33. A liquid crystal display device having a plurality of pixels, each of the plurality of pixels comprises:

n source signal lines (n is an integer, where $2 \leqq n$);

a write-in gate signal line;

n read gate signal lines;

n write-in transistors;

n read transistors;

n×m storage circuits for storing m frames (m is an integer, where $1 \leqq m$) of an n bit digital image signal;

n write-in storage circuit selection portions;

n read storage circuit selection portions; and a liquid crystal element, wherein gate electrodes of n write-in transistors are respectively electrically connected to the write-in gate signal lines, one of a source region and a drain region is electrically connected to any one of the different n source signal lines and the other is electrically connected to any one of the different signal input portions of the n write-in storage circuit selection portions, wherein the n write-in storage circuit selection portions respectively have m signal output portions, and the m signal output portions respectively are electrically connected to signal input portions of the different m storage circuits, wherein the n read storage circuit selection portions respectively have m signal input portions, and the m signal input portions respectively are electrically connected to the signal output portions of the different m storage circuits, and wherein gate electrodes of the n read transistors respectively are electrically connected to any one of the different n read gate signal lines, one of the source region and the drain region is electrically connected to any one of the different signal output portions of the n read storage circuit selection portions, and the other is electrically connected to one electrode of the liquid crystal element.

34. A device according to claim 33, wherein the write-in storage circuit selection portion selects any one of m storage circuits, and becomes in continuity with one of a source region or a drain region of the write-in transistor to thereby write in the digital image signal to the storage circuit; and wherein the read storage circuit selection portion selects any one of the storage circuits storing the digital image signal, and becomes in continuity with one of a source region or a drain region of the read transistor to thereby read the digital image which is stored.

35. A device according to claim 33, further comprising:

a first latch circuit holding the 1 bit digital image signal from among n bit digital image signals (n is an integer, where $2 \leqq n$) according to the sampling pulse; and a second latch circuit to which the 1 bit digital image signal held in the first latch circuit is transferred, and which outputs the 1 bit digital image signal to the source signal line.

36. A device according to claim 33, further comprising:

a shift register which sequentially outputs a sampling pulse according to a clock signal and a start pulse; and a first latch circuit holding a 1 bit digital image signal from among n bit digital image signals (n is an integer, where $2 \leqq n$) according to the sampling pulse, and outputs the 1 bit digital image signal to the source signal line.

37. A device according to claim 33, wherein the storage circuit is a static memory (SRAM).

38. A device according to claim 33, wherein the storage circuit is a ferroelectric memory (FeRAM).

39. A device according to claim 33, wherein the storage circuit is a dynamic memory (DRAM).

40. A device according to claim 33, wherein the storage circuit is formed on a glass substrate.

41. A device according to claim 33, wherein the storage circuit is formed on a plastic substrate.

42. A device according to claim 33, wherein the storage circuit is formed on a stainless substrate.

43. A device according to claim 33, wherein the storage circuit is formed on a monocrystalline wafer substrate.

44. An electronic device using a liquid crystal display device according to claim 33.

45. A method according to claim 44, wherein the electronic device is selected from the group consisting of a television, a personal computer, a portable terminal, a video camera or a head mount display.

46. A method of driving a liquid crystal display device comprising the steps of:

generating a sampling pulse in a shift register;

inputting the sampling pulse to a latch circuit;

inputting an n bit digital image signal (n is an integer, where $2 \leqq n$) in the latch circuit;

holding the n bit digital image signal in accordance with the sampling pulse;

outputting the n bit digital image signal from the latch circuit into a source signal line;

selecting a gate signal line in accordance with a gate signal line selection pulse;

inputting the n bit digital image signal from the source signal line to a plurality of pixels, in a row where the gate signal line is selected;

selecting a storage circuit in the plurality of pixels;

writing the n bit digital image signal into the storage circuit via a write-in transistor; and performing the n bit digital image signal read from the storage circuit via a read transistor.

47. A method according to claim 46, wherein in a display period of a still image, the source signal line driver circuit is stopped, and the n bit digital image signal stored in the storage circuit is repeatedly read to display the still image.

48. A method according to claim 46, wherein said method of driving the liquid crystal display device is used in an electronic device.

49. A method according to claim 48, wherein the electronic device is selected from the group consisting of a television, a personal computer, a portable terminal, a video camera or a head mount display.

50. A method of driving a liquid crystal display device comprising the steps of:

generating a sampling pulse in a shift register;

inputting the sampling pulse to a latch circuit;

inputting an n bit digital image signal (n is an integer, where $2 \leqq n$) in the latch circuit;

holding the n bit digital image signal in accordance with the sampling pulse;

outputting the n bit digital image signal from the latch circuit into a source signal line;

selecting a gate signal line sequentially from the first row in accordance with a gate signal line selection pulse;

inputting the n bit digital image signal from the source signal line to a plurality of pixels, in a row where the gate signal line is selected;

selecting a storage circuit in the plurality of pixels;

writing the n bit digital image signal into the storage circuit via a write-in transistor; and performing the n bit digital image signal read from the storage circuit via a read transistor.

51. A method according to claim 50, wherein in a display period of a still image, the source signal line driver circuit is stopped, and the n bit digital image signal stored in the storage circuit is repeatedly read to display the still image.

52. A method according to claim 50, wherein said method of driving the liquid crystal display device is used in an electronic device.

53. A method according to claim 52, wherein the electronic device is selected from the group consisting of a television, a personal computer, a portable terminal, a video camera or a head mount display.

54. A method of driving a liquid crystal display device comprising the steps of:

generating a sampling pulse in a shift register;

inputting the sampling pulse to a latch circuit;

inputting an n bit digital image signal (n is an integer, where $2 \leqq n$) in the latch circuit;

holding the n bit digital image signal in accordance with the sampling pulse;

outputting the n bit digital image signal from the latch circuit into a source signal line;

selecting a gate signal line arbitrary in accordance with a gate signal line selection pulse;

inputting the n bit digital image signal from the source signal line to a plurality of pixels, in a row where the gate signal line is selected;

selecting a storage circuit in the plurality of pixels;

writing the n bit digital image signal into the storage circuit via a write-in transistor; and performing the n bit digital image signal read from the storage circuit via a read transistor.

55. A method according to claim 54, wherein in a display period of a still image, the source signal line driver circuit is stopped, and the n bit digital image signal stored in the storage circuit is repeatedly read to display the still image.

56. A method according to claim 54, wherein said method of driving the liquid crystal display device is used in an electronic device.

57. A method according to claim 56, wherein the electronic device is selected from the group consisting of a television, a personal computer, a portable terminal, a video camera or a head mount display.

58. A device according to claim 11, wherein $m>1$.

59. A device according to claim 21, wherein $m>1$.

60. A device according to claim 33, wherein $m>1$.

61. A liquid crystal display device according to claim 1, wherein the write-in storage circuit selection portion is electrically connected between the write-in transistor and the selected one of the plurality of storage circuits, and wherein the read storage circuit selection portion is electrically connected between the selected one of the plurality of storage circuits and the read transistor.

* * * * *